US006229974B1

(12) United States Patent
Noda

(10) Patent No.: US 6,229,974 B1
(45) Date of Patent: May 8, 2001

(54) PROCESS CARTRIDGE PUSH-IN MECHANISM AND ELECTROPHOTOGRAPHIC IMAGE FORMING APPARATUS HAVING THE SAME

(75) Inventor: Shinya Noda, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/536,477

(22) Filed: Mar. 28, 2000

(30) Foreign Application Priority Data

Apr. 2, 1999 (JP) ..... 11-096254

(51) Int. Cl.[7] ..... G03G 21/18; G03G 21/16
(52) U.S. Cl. ..... 399/111; 399/114
(58) Field of Search ..... 399/111, 114, 399/125, 126

(56) References Cited

U.S. PATENT DOCUMENTS

| | | | | |
|---|---|---|---|---|
| 4,470,689 | * | 9/1984 | Nomura et al. | 399/114 |
| 5,276,480 | * | 1/1994 | Takahashi | 399/125 |
| 5,331,372 | | 7/1994 | Tsuda et al. . | |
| 5,404,198 | | 4/1995 | Noda et al. . | |
| 5,463,446 | | 10/1995 | Watanabe et al. . | |
| 5,470,635 | | 11/1995 | Shirai et al. | 428/131 |
| 5,475,470 | | 12/1995 | Sasago et al. . | |
| 5,488,459 | | 1/1996 | Tsuda et al. . | |
| 5,510,878 | | 4/1996 | Noda et al. . | |
| 5,583,613 | | 12/1996 | Kobayashi et al. . | |
| 5,602,623 | | 2/1997 | Nishibata et al. | 399/111 |
| 5,608,509 | | 3/1997 | Shirai et al. | 399/351 |
| 5,623,328 | | 4/1997 | Tsuda et al. | 399/111 |
| 5,640,650 | | 6/1997 | Watanabe et al. | 399/117 |
| 5,659,847 | | 8/1997 | Tsuda et al. | 399/113 |
| 5,669,042 | | 9/1997 | Kobayashi et al. | 399/111 |
| 5,749,027 | | 5/1998 | Ikemoto et al. | 399/113 |
| 5,774,766 | | 6/1998 | Karakama et al. | 399/111 |
| 5,828,928 | | 10/1998 | Sasago et al. | 399/111 |
| 5,878,310 | | 3/1999 | Noda et al. | 399/117 |
| 5,890,036 | | 3/1999 | Karakama et al. | 399/119 |
| 5,899,602 | | 5/1999 | Noda et al. | 399/111 |
| 5,920,752 | | 7/1999 | Karakama et al. | 399/111 |
| 5,930,562 | | 7/1999 | Noda et al. | 399/114 |
| 5,943,528 | | 8/1999 | Akutsu et al. | 399/110 |
| 6,101,351 | * | 8/2000 | Suda et al. | 399/114 |

* cited by examiner

*Primary Examiner*—Susan S. Y. Lee
(74) *Attorney, Agent, or Firm*—Fitzpatrick, Cella, Harper & Scinto

(57) ABSTRACT

A push-in mechanism for mounting a process cartridge in a mounting position provided in the main body of an electrophotographic image forming apparatus, wherein the process cartridge integrally includes an electrophotographic photosensitive member and process device acting on the electrophotographic photosensitive member, the mechanism including: a) a moving device for contacting the process cartridge and moving the process cartridge to the mounting position in response to a closing operation of an openable cover provided in the main body of the electrophotographic image forming apparatus, wherein the openable cover can be opened or closed with respect to the main body of the electrophotographic image forming apparatus and is to be opened for mounting or detaching the process cartridge to or from the main body of the electrophotographic image forming apparatus; and b) a separation device for separating the moving device from the process cartridge after the process cartridge is moved to the mounting position.

22 Claims, 19 Drawing Sheets

PROCESS CARTRIDGE PUSH-IN MECHANISM AND ELECTROPHOTOGRAPHIC IMAGE FORMING APPARATUS HAVING THE SAME

BACKGROUND OF THE INVENTION

1. Field of the Invention

The present invention relates to an electrophotographic image forming apparatus to which a process cartridge is detachably mountable for forming an image on a recording medium, and a process cartridge push-in mechanism for pushing the process cartridge into a main body of the image forming apparatus in mounting the process cartridge to the main body of the image forming apparatus.

The term "electrophotographic image forming apparatus" refers to an apparatus for forming an image on a recording medium by an electrophotographic image forming process. Examples of such image forming apparatus include an electrophotographic copying apparatus, an electrophotographic printer (for example, a laser beam printer and an LED printer), a facsimile apparatus and a word processor and the like.

Also the term "process cartridge" refers to a cartridge integrally containing charging means, developing means or cleaning means and an electrophotographic photosensitive drum, and rendered detachably mountable on the main body of the electrophotographic image forming apparatus. It also refers to a cartridge integrally containing at least one of the charging means, developing means and cleaning means, and an electrophotographic photosensitive drum and rendered detachably mountable on the main body of the electrophotographic image forming apparatus. It further refers to a cartridge integrally containing at least developing means and an electrophotographic photosensitive drum and rendered detachably mountable on the main body of the image forming apparatus.

2. Related Background Art

The electrophotographic image forming apparatus (hereinafter referred to as an image forming apparatus) utilizing the electrophotographic image forming process achieves image recording by applying selective exposure to a uniformly charged image bearing member (photosensitive drum) to form a latent image thereon, developing such latent image with developer (toner) to form a visible image, transferring such visible image (toner image) onto a recording medium and fixing the transferred image onto the recording medium. The photosensitive drum after the image transfer is subjected, after the removable of remaining toner by cleaning means, to uniform charging by charging means and is used again in the image forming process starting from the exposure step.

In the image forming apparatus utilizing such electrophotographic image forming process, there is already adopted a process cartridge system in which an electrophotographic photosensitive member and process means acting on the electrophotographic photosensitive member are made integrally into a cartridge, which is detachably mountable on the main body of the image forming apparatus. Such process cartridge can significantly improve operability, since the maintenance of the apparatus can be achieved by the user instead of the serviceman. Such a process cartridge system is, therefore, widely employed in image forming apparatus.

Such process cartridge comprises a cleaning unit rotatably supporting the photosensitive drum and incorporating cleaning means and charging means, and a developing unit incorporating developing means and a toner container. The developing unit is provided with a developer bearing member (developing roller) of the developing means, supported rotatably with respect to the cleaning unit so as to be opposed in parallel to the photosensitive drum with a predetermined gap thereto, and a spacer for maintaining the predetermined gap between the developing roller and the photosensitive drum with a predetermined pressure in order to maintain the predetermined gap therebetween.

In order to obtain a satisfactory image in the image forming apparatus utilizing such process cartridge, it is required that the process cartridge is properly mounted in a predetermined position in the image forming apparatus and that the interfaces, such as electrical contacts and drive transmitting portions, are properly connected.

Consequently, there is being conceived and commercialized a configuration having positioning pins provided on the process cartridge on an axis of the photosensitive drum and a cartridge mounting and dismounting guide as guide grooves provided on the main body of the image forming apparatus for guiding and positioning the above-mentioned positioning pins, wherein the process cartridge is limited in rotation about the positioning pins by abutting against a fixed member in the main body of the image forming apparatus and a spring is provided on an openable and closable cover of the main body of the image forming apparatus for biasing the process cartridge, mounted in the main body of the apparatus, in the mounting direction.

There is also conceived a configuration having a back cover, matching an external shape of the process cartridge, on the internal face of the openable and closable cover, wherein the process cartridge is pushed into the proper position by the closing operation of the openable and closable cover.

SUMMARY OF THE INVENTION

The present invention provides a further development of the conventional technology mentioned above.

An object of the present invention is to provide an electrophotographic image forming apparatus and a process cartridge push-in mechanism that can securely mount the process cartridge on the cartridge mounting portion of the image forming apparatus.

Another object of the present invention is to provide an electrophotographic image forming apparatus and a process cartridge push-in mechanism, in which a push-in force does not act on the process cartridge, after the process cartridge has been mounted on the cartridge mounting portion of the image forming apparatus.

Still another object of the present invention is to provide an electrophotographic image forming apparatus and a process cartridge push-in mechanism, in which moving means does not act on the process cartridge, after the process cartridge has been mounted on the cartridge mounting portion of the image forming apparatus.

Still another object of the present invention is to provide an electrophotographic image forming apparatus and a process cartridge push-in mechanism, comprising:

a) moving means coming into contact with the process cartridge in response to a closing operation of an openable and closable cover provided in a main body of the electrophotographic image forming apparatus, for moving the process cartridge to a mounted position, wherein the openable and closable cover can be opened or closed with respect to the main body of the electrophotographic image forming apparatus and is to be opened for mounting and dismounting the process cartridge into and from the main body of the electrophotographic image forming apparatus; and b) separation means for separating the moving means from the process cartridge after the process cartridge is moved to the mounted position.

These and other objects, features and advantages of the present invention will become more apparent upon consideration of the following description of the preferred embodiments of the present invention taken in conjunction with the accompanying drawings.

BRIEF DESCRIPTION OF THE DRAWINGS

FIG. 19 is a lateral view showing a state in which the openable and closable cover is opened and the pushing lever is pushed in.

DETAILED DESCRIPTION OF THE PREFERRED EMBODIMENTS

In the following description, the longitudinal direction refers to a direction crossing a conveying direction of a recording medium and parallel to the recording medium.

Embodiment 1

In the following there will be explained, with reference to FIG. 1, a process cartridge and an electrophotographic image forming apparatus capable of mounting such process cartridge.

At first there will be explained the entire configuration of the process cartridge and the electrophotographic image forming apparatus utilizing the same, and the mounting and dismounting structure for the process cartridge will be explained next.

(Entire configuration)

Figure 1:
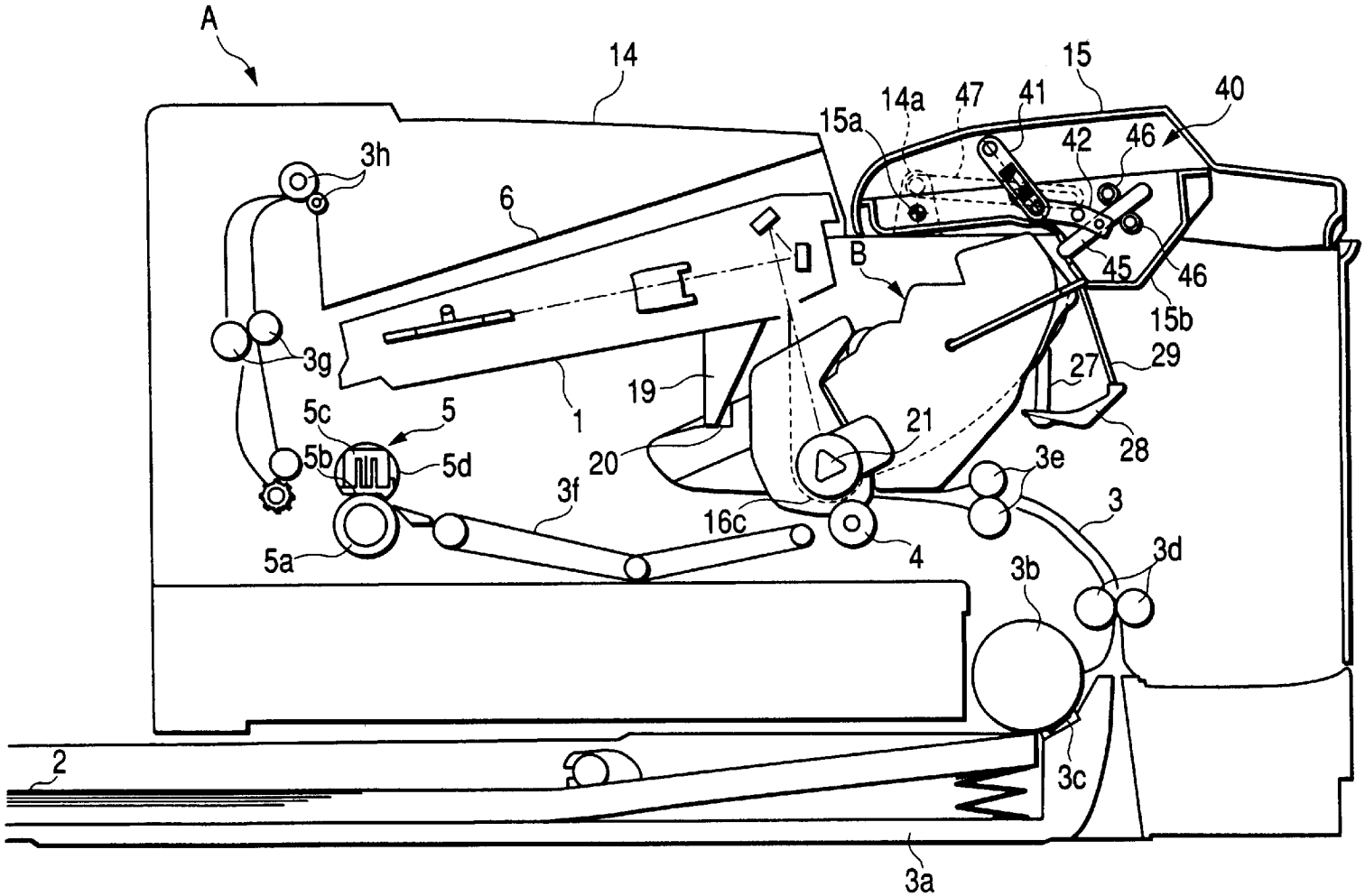
FIG. 1 is the vertical cross-sectional view schematically showing a configuration of an image forming apparatus according to an embodiment 1 of the present invention.

The electrophotographic image forming apparatus (laser beam printer, which is hereinafter simply referred to as an image forming apparatus) A irradiates, as shown in FIG. 1, a drum-shaped electrophotographic photosensitive member with information-bearing light coming from an optical system 1 and corresponding to image information to form a latent image on the photosensitive member and developing the latent image with developer (hereinafter referred to as "toner") to obtain a toner image. In synchronism with the formation of the toner image, a recording medium 2 is separated and fed, one by one, from a feed cassette 3*a* by a pickup roller 3*b* and a pressure contact member 3*c* in pressure contact with the pickup roller 3*b*, and conveyed by conveying means 3 comprising conveying rollers 3*d*, registration rollers 3*e*, etc. The toner image formed on the electrophotographic photosensitive member of a process cartridge B is transferred onto the recording medium 2 by a voltage application to a transfer roller 4 as transfer means, and the recording medium 2 is conveyed by a conveyor belt 3*f* to fixing means 5. The fixing means 5 is composed of a driving roller 5*a* and a rotary fixing member 5*d* constituted by a tubular sheet, which is provided with a heater 5*b* in the tubular sheet and is rotatably supported by a support member 5*c*, and applies heat and pressure to the passing recording medium 2, thereby fixing the transferred toner image. The recording medium 2 is then conveyed by paired discharge rollers 3*g*, 3*h* and is discharged to a discharge unit 6 through a surface reverse conveying path.

(Process cartridge)

Figure 2:
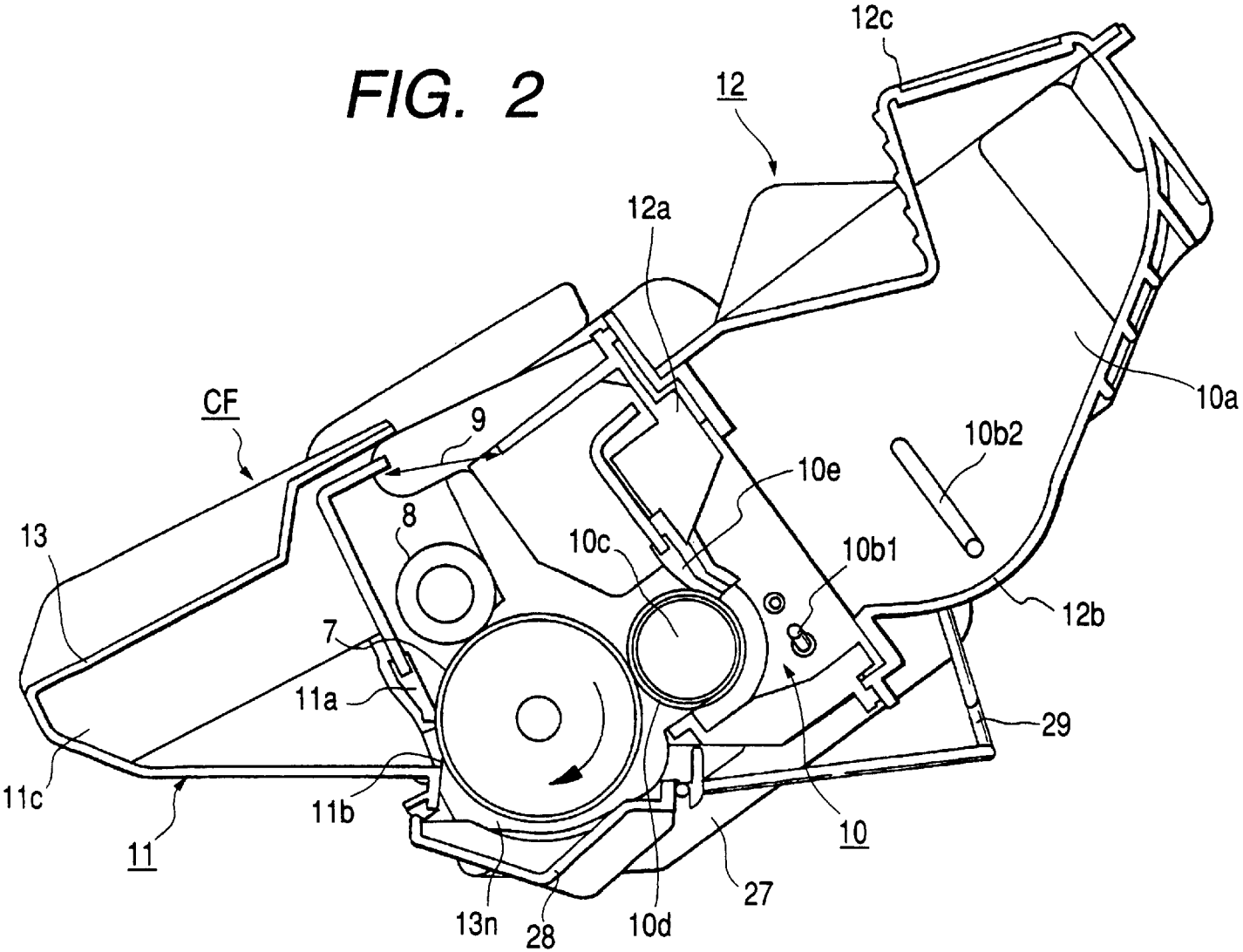
FIG. 2 is the vertical cross-sectional view schematically showing a configuration of a process cartridge.

On the other hand, the above-mentioned process cartridge B is provided with the electrophotographic photosensitive member and at least one of process means. Examples of such process means include charging means for charging the electrophotographic photosensitive member, developing means for developing the latent image formed on the electrophotographic photosensitive member, and cleaning means for cleaning the toner remaining on the surface of the electrophotographic photosensitive member. The process cartridge B of the present embodiment is so constructed, as shown in FIG. 2, as to rotate a photosensitive drum 7 as the electrophotographic photosensitive member having a photosensitive layer, to apply a voltage to a charging roller 8 as the charging means to uniformly charge the surface of the photosensitive drum 7, to expose the charged photosensitive drum 7 to a light image coming from the optical system 1 through an exposure aperture 9 to form a latent image, and to develop the latent image with developing means 10.

The developing means 10 is so constructed as to feed the toner with a first feed member 10*b*1 and a second feed member 10*b*2 as rotatable toner feed means in a toner containing portion 10*a*, to rotate a developing roller 10*d* as a rotary developing member incorporating a stationary magnet 10*c*, to form a toner layer, having a triboelectric charge generated by a developing blade 10*e*, on the surface of the developing roller 10*d*, and to transfer the toner to the photosensitive drum 7 according to the latent image to form a visible toner image.

After the toner image is transferred onto the recording medium 2 by the application, to the transfer roller 4, of a voltage opposite in polarity to that of the toner image, the toner remaining on the photosensitive drum 7 is removed by cleaning means 11, in which the remaining toner is scraped off by a cleaning blade 11*a*, gathered by a dip sheet 11*b*, and collected in a removed toner containing portion 11*c*.

The above-mentioned members, including the photosensitive drum 7, are made into a cartridge by containing in a cartridge frame CF, which is formed by combining a toner development frame member 12 obtained by welding a development frame 12*a*, a development lower frame 12*b* and a cover member 12*c*, with a cleaning frame member 13. The cartridge is detachably mountable on the cartridge mounting means of the main body 14 of the apparatus.

(Mounting and dismounting structure of process cartridge)

In the following there will be explained the structure for mounting and dismounting the above-described process cartridge B to and from the image forming apparatus A.

Figure 4:
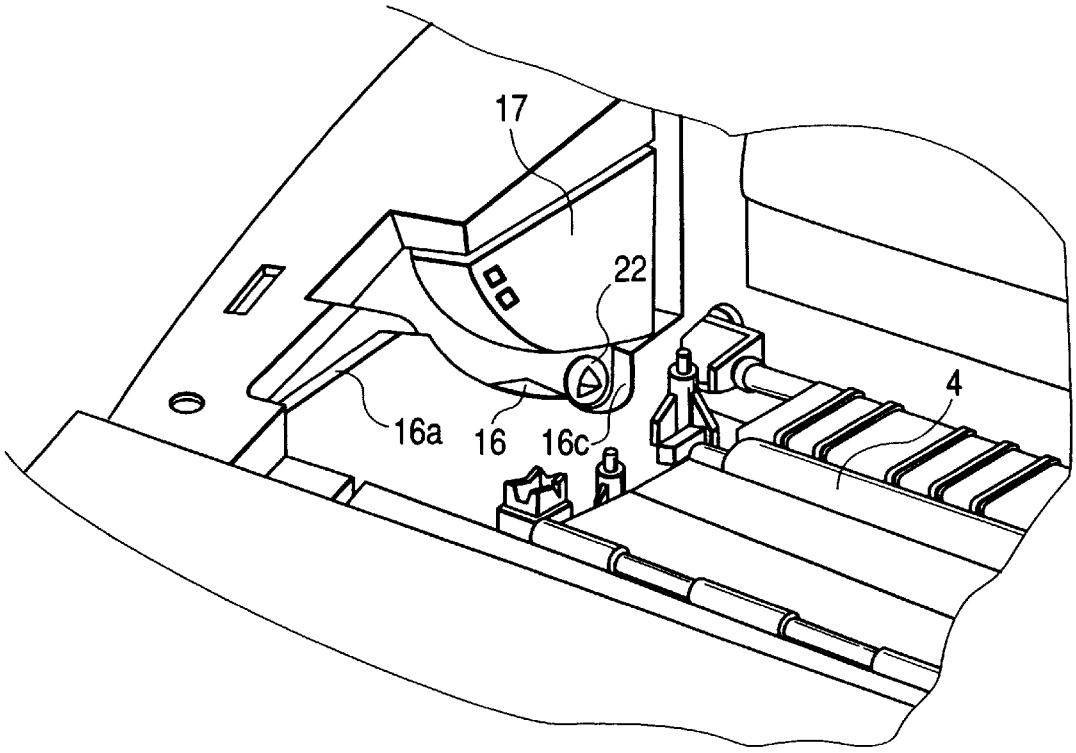
FIGS. 4 and 5 are perspective views showing mounting guides for the process cartridge.
Figure 5:
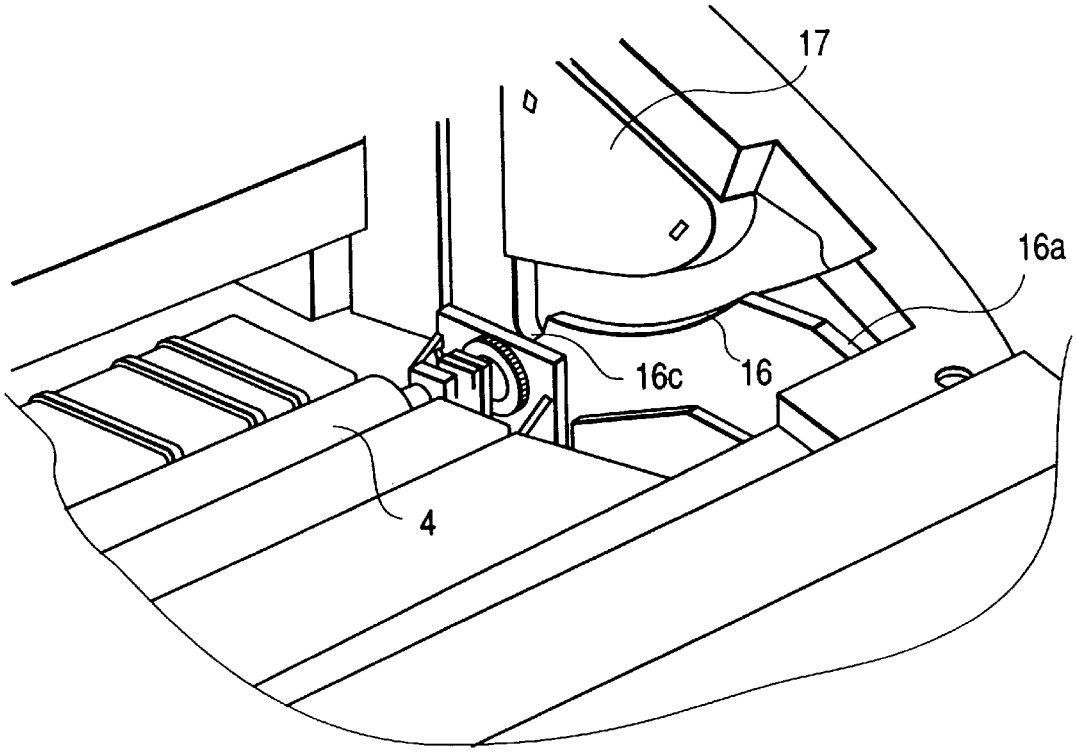

The mounting and dismounting of the process cartridge B are executed by opening an openable and closable cover 15. As shown in FIG. 1, the openable and closable cover 15 is pivotable about a shaft 15*a* attached to the main body 14 of the apparatus. In the opened state of the openable and closable cover 15 about the shaft 15*a*, there are exposed, as shown in FIGS. 4 and 5, the cartridge mounting means comprising guide rails 16 formed in a substantially symmetrical manner on both lateral faces of the cartridge mounting space, the guide rails 16 extending forwardly and downwardly and being formed in a curved shape expanding downwardly (substantially arc formed in the present embodiment), and guide members 17 provided above the guide rails 16. At the entrance side of the guide rail 16, there is formed an inclined surface 16*a* as an engaging portion for engaging with a link member 29 of the process cartridge B.

Figure 6:
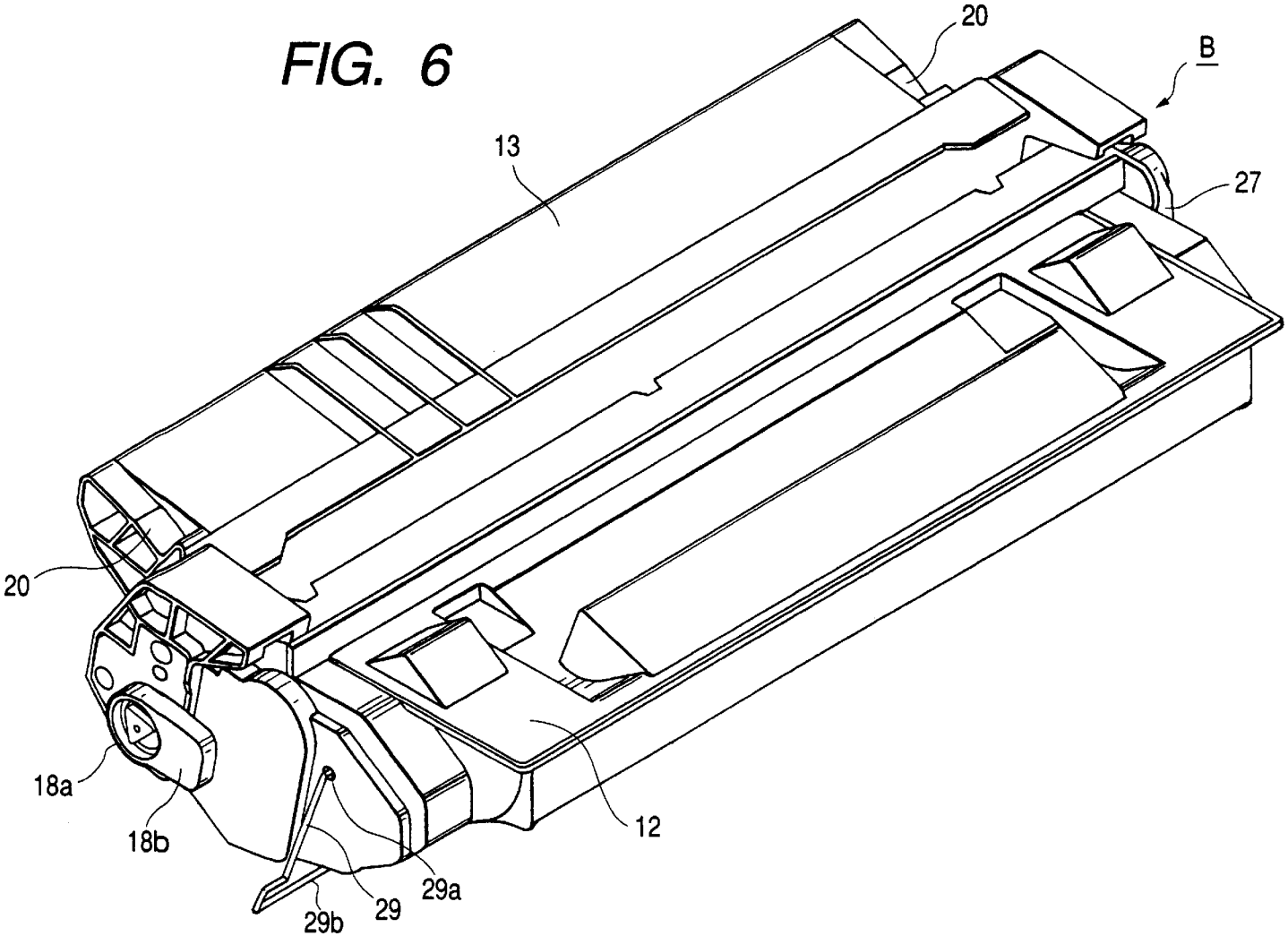
FIGS. 6 and 7 are perspective views showing the process cartridge.
Figure 7:
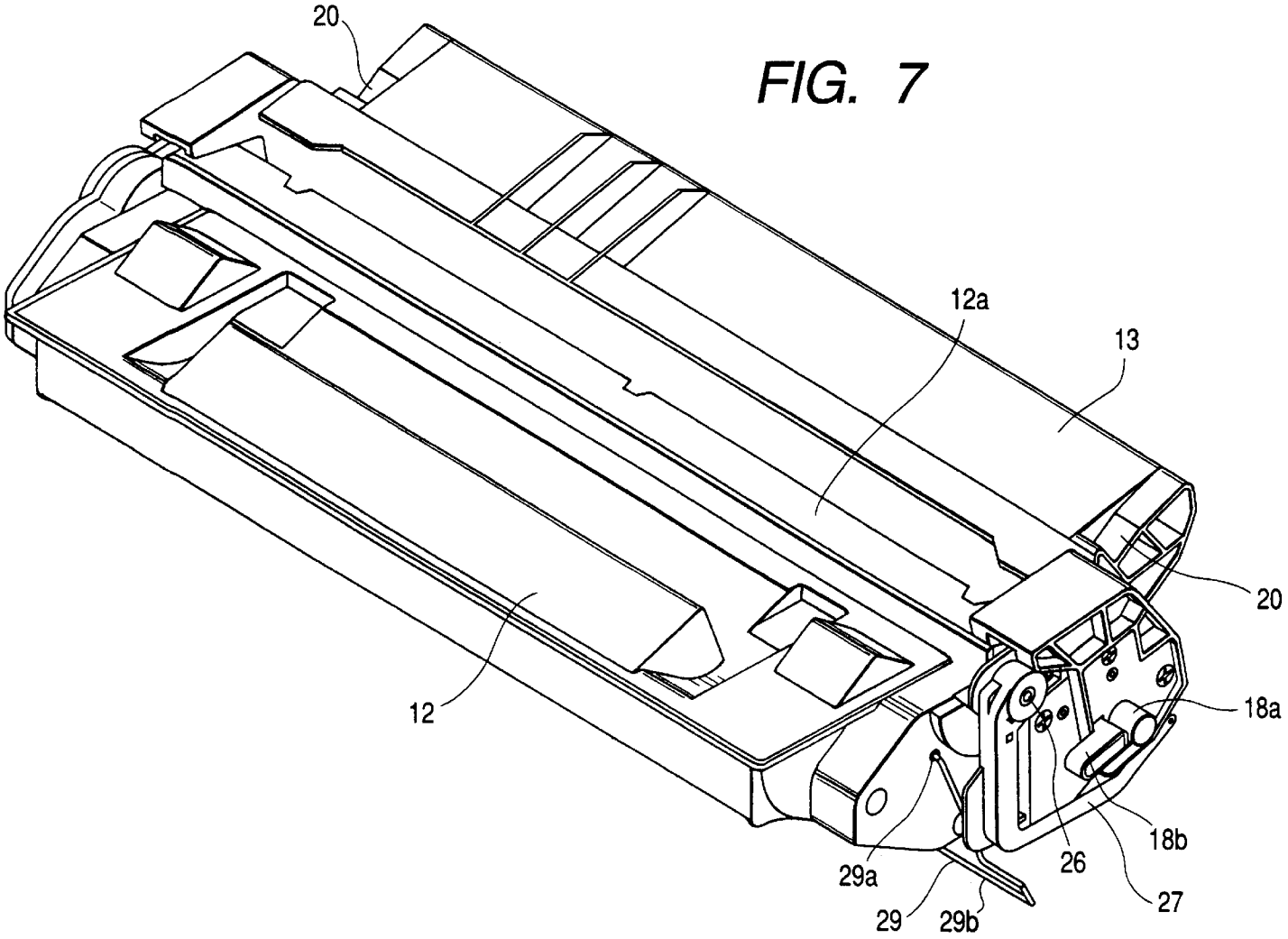

On the other hand, in correspondence with the guide rails 16, the process cartridge B is provided, on both external faces in the longitudinal direction thereof, with guide portions to be guided along the guide rails 16. The guide portions are so constructed as to protrude from substantially symmetrical positions on both external faces in the longitudinal direction of the cartridge frame member CF, and are composed of, as shown in FIGS. 6 and 7, a boss 18*a* as a first guide portion and a rib 18*b* as a second guide portion. The boss 18*a* is positioned on the extension of the rotary axis of the photosensitive drum 7, while the rib 18*b* is extended from the boss 18*a* in a curved shape expanding downwardly (substantially arc shaped in the present embodiment) matching the shape of the guide rail 16 in the inserting direction of the process cartridge B.

Figure 3:
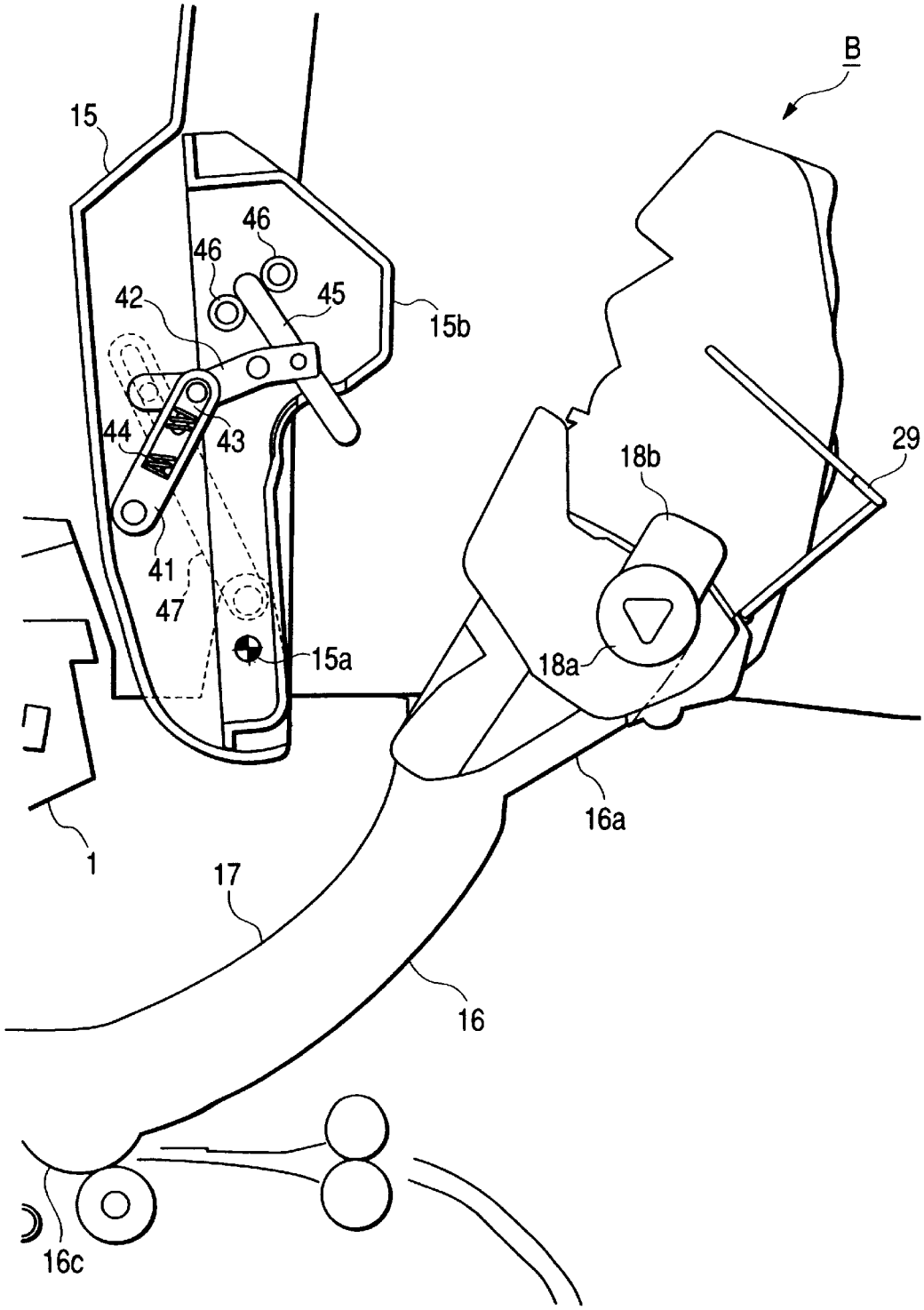
FIG. 3 is the schematic lateral view showing a mounting of the process cartridge in a main body of the image forming apparatus.

In the above-described configuration, the process cartridge B is mounted by inserting the leading end of the process cartridge under the optical system 1 of the image forming apparatus A, with the boss 18*a* and the rib 18*b* along the guide rail 16 as shown in FIG. 3. Since the guide rail 16 and the guide member 17 positioned thereabove are formed in the substantially arc shape while the rib 18*b* is also formed in a substantially same arc shape, the process cartridge B becomes substantially horizontal as it is inserted. As the process cartridge B is further pushed in, impingement members 19 provided in the main body 14 of the apparatus impinge on contact faces 20 provided in the vicinity of both end portions of the leading end of the cleaning frame member 13, and then the bosses 18*a* of the process cartridge B drop in receiving recesses 16*c* formed at the terminated ends of the guide rails 16. Thus, a coupling 21 (cf. FIG. 1) provided at the center of a flange fixed to a lateral end of the photosensitive drum 7 can be fitted with a drive transmitting portion 22 (cf. FIG. 4) so provided as to advance in interlock with the closing operation of the openable and closable cover 15 of the main body 14, whereby the driving force can be transmitted to the process cartridge B.

In the lower part of the cartridge frame member CF, there is formed an aperture 13*n* for contacting the photosensitive drum 7 with the conveyed recording medium 2 (cf. FIG. 2), and such aperture 13*n* is closed by a drum shutter member 28 when the process cartridge B is not used, thereby protecting the photosensitive drum 7. As shown in FIG. 7, the shutter member 28 is pivotably supported by a distal end of a shutter arm 27 rotatable about a shaft 26 provided on one external side face in the longitudinal direction of the developing frame member 12*a* and is pivotably supported by a link member 29 rotatable about a rotary center 29*a* on both external side faces in the longitudinal direction of the developing frame member 12*a* so that the shutter member 28 is rotatably supported. Thus, the shutter member 28 constitutes a link in a quadric link mechanism on one side shown in FIG. 1, and the shutter arm 27 and the link member 29 constitute shutter support members for supporting the shutter member 28.

When the process cartridge B is inserted along the guide rails 16 as explained in the foregoing, slide members 29b protruding on both ends in the longitudinal direction of the link member 29 come into contact with the inclined surfaces (receiving surfaces) 16*a* of the guide rails 16 and then the process cartridge B advances in the mounting direction, whereby the shutter member 28 is opened. On the other hand, when the process cartridge B is dismounted, the shutter member 28 is automatically closed by the biasing of a torsion coil spring (not shown) mounted on the shaft 26. In the above-described configuration, the shutter arm 27 and the shutter member 28 are composed of a plastic material, while the link member 29 is composed of an elastic wire, such as piano steel wire.

Figure 8:
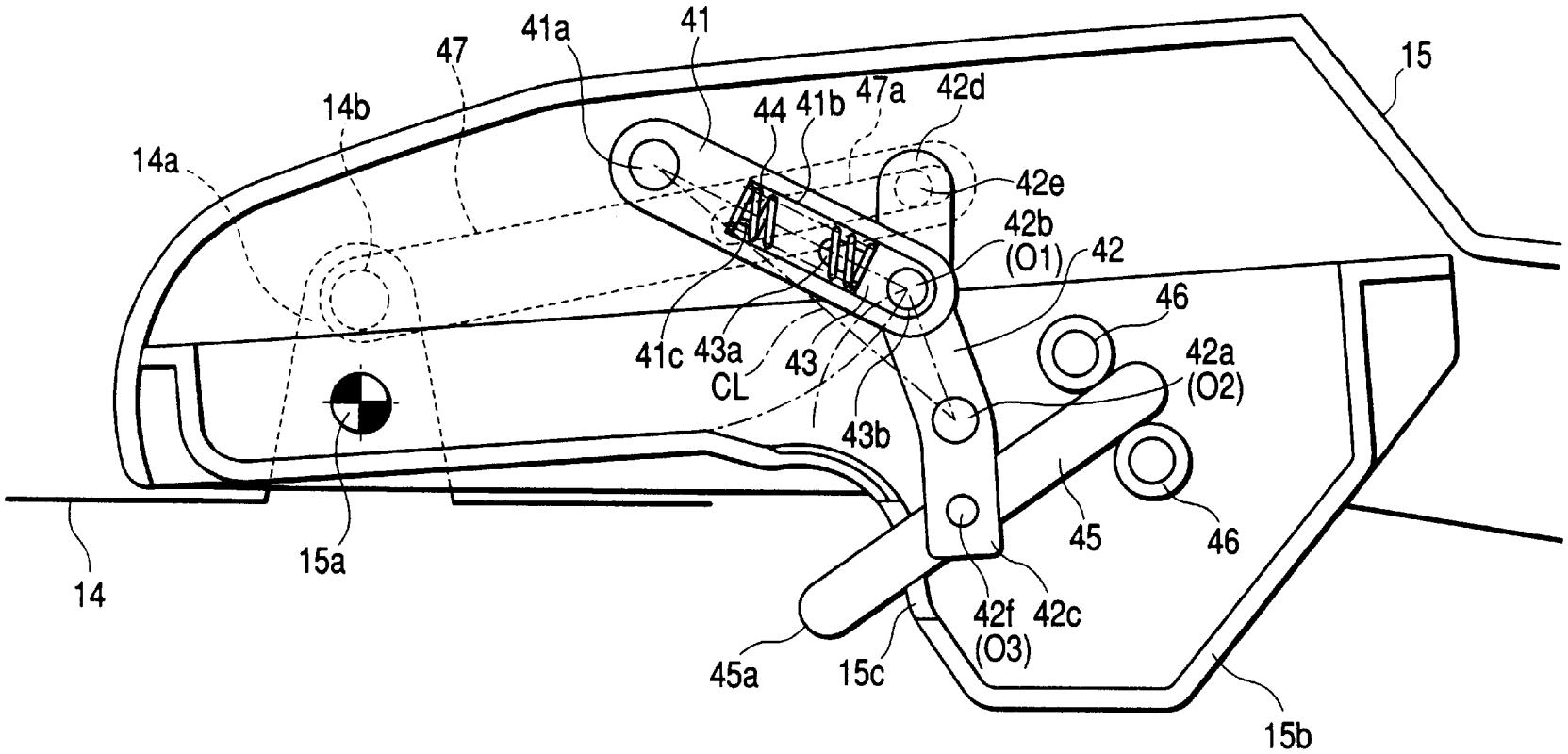
FIG. 8 is a lateral view of a process cartridge push-in mechanism.

In the following, there will be explained the configuration of a push-in mechanism 40 for the process cartridge B, provided on the openable and closable cover 15. As shown in FIG. 8, the push-in mechanism 40 is constituted by mounting a first rocking lever 41 as a link on the openable and closable cover 15 in a rotatable manner about a shaft 41*a*, and mounting a second rocking lever 42 as a crank on a back cover 15*b* fixed on the inside of the openable and closable cover 15 in a rotatable manner about a shaft 42*a* (rotary center O2). The first rocking lever 41 is provided therein with a slide groove 41*b*, in which a slider 43 is slidably provided. The slider 43 is provided, at one end of the slider 43 on a side of the shaft 41*a* of the first rocking lever 41, with a projection 43*a*, while the first rocking lever 41 is provided, at an end of the slide groove 41*b* opposed to the projection 43*a* of the slider 43, with a projection 41*c*, and a compression coil spring 44 is positioned in a compressed state between the slider 43 and the end of the slide groove 41*b* with both ends of the spring 44 engaging with the respective projections 43*a*, 41*c*. The slider 43 is provided with a fitting hole 43*b* into which a shaft 42*b* of the second rocking lever 42 is rotatably fitted (rotary center O1).

Figure 9:
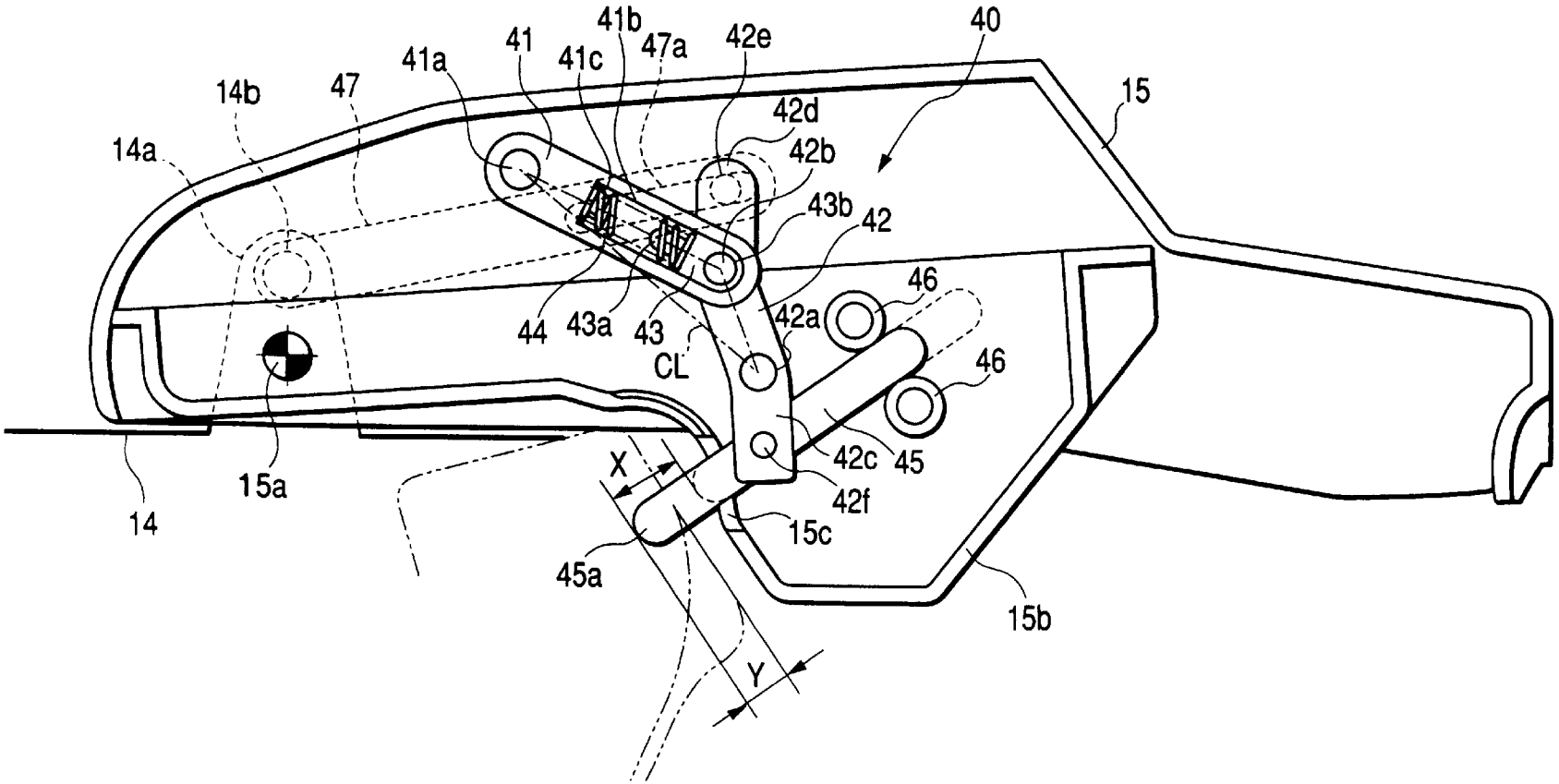
FIG. 9 is a lateral view of the process cartridge push-in mechanism (with a push-in lever in a front limit position)
Figure 10:
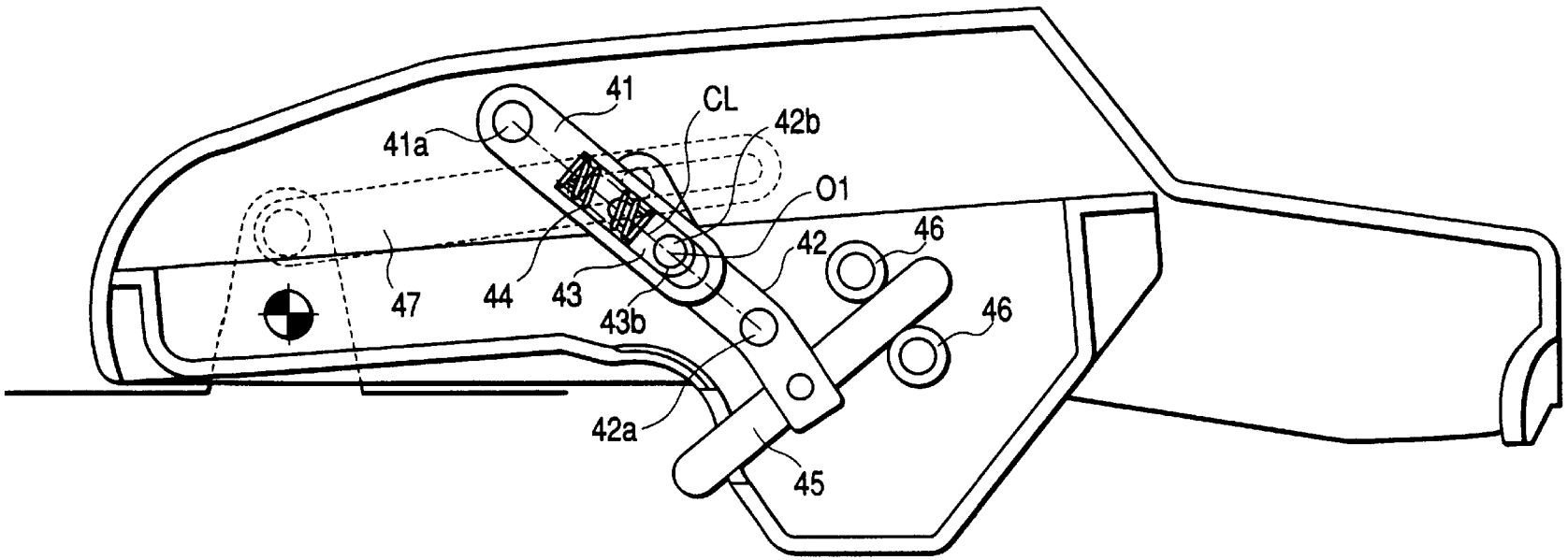
FIG. 10 is a lateral view of the process cartridge push-in mechanism (with the push-in lever in an intermediate position)
Figure 11:
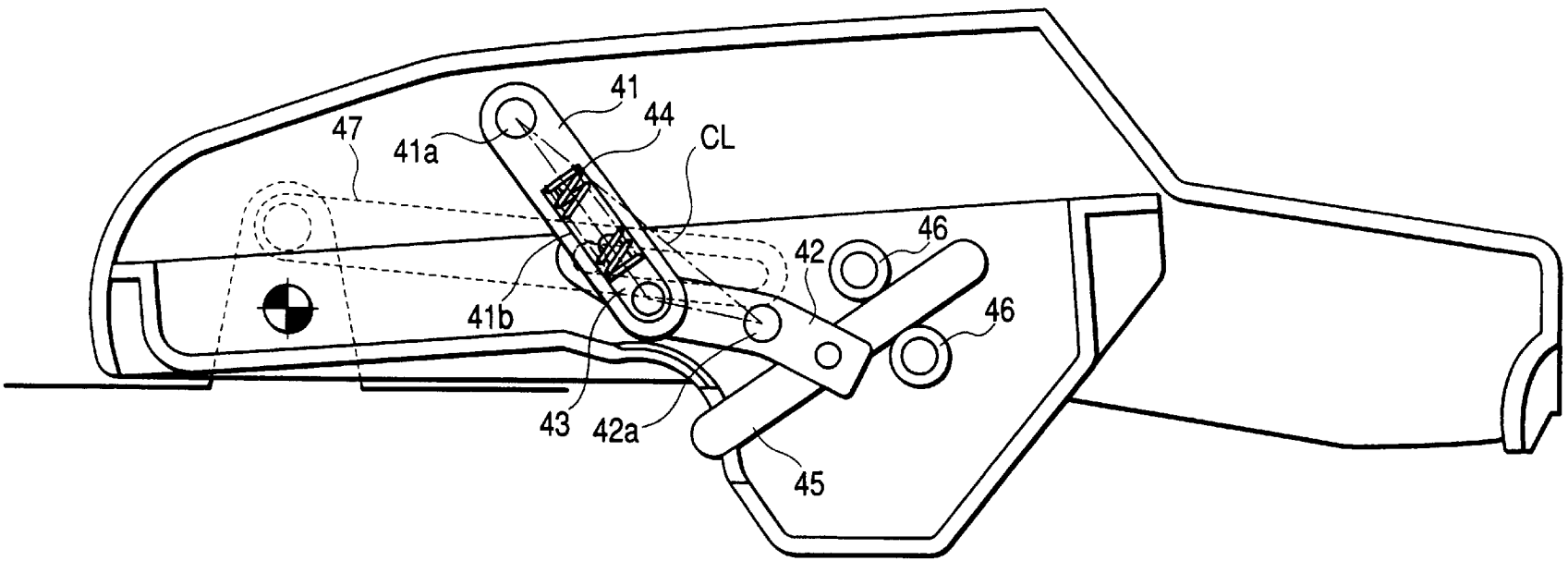
FIG. 11 is a lateral view of the process cartridge push-in mechanism (with the push-in lever in a rear limit position)

Based on the above-described configuration, a dead center is defined when the center O1 of the fitting hole 43*b* of the slider 43 (or the center of the shaft 42*b* of the second rocking lever 42) lies on a center line CL (hereinafter referred to as a rocking lever center line) connecting the shaft 41*a* of the first rocking lever 41 and the shaft 42*a* of the second rocking lever 42 (cf. FIG. 10), and, otherwise (namely if the fitting hole 43*b* is displaced to the left or to the right from the rocking lever center line CL), the first and second rocking levers 41, 42 are constantly biased toward the left or right of such rocking lever center line CL by the elastic force of the compression coil spring 44 provided in the first rocking lever 41, and stay in a position where the rear end of the slider 43 impinges on the rear end of the slide groove 41*b* (cf. FIGS. 8, 9 and 11). In response to the rocking motion of the first and second rocking levers 41, 42, the slider 43 moves in the slide groove 41*b* by an amount obtained by subtracting the distance between the centers of the shafts 41*a*, 42*a* as the rotary centers of the first and second rocking levers 41, 42 from a sum of the distance from the center of the shaft 41*a* as the rotary center of the first rocking lever 41 in the stationary state to the center of the fitting hole 43*b* of the slider 43 and the distance from the center of the shaft 42*a* as the rotary center of the second rocking lever 42 to the center of the fitting hole 43*b* of the slider 43. Consequently, the maximum moving amount of the slider 43 from a position where the slider 43 is at the terminated end on the front end side of the slide groove 41*b* appears in a situation where the fitting hole 43*b* of the slider 43 lies on the aforementioned rocking lever center line CL, and the biasing force of the compression coil spring 44 becomes largest in this situation.

The second rocking lever 42 is extended beyond the shaft 42*a* in a direction opposite to the side of the shaft 42*b* to form an arm portion 42*c*, on which a push-in lever 45 is rotatably mounted by a pin 42*f* (rotary center O3). An end 45*a* of the push-in lever 45 protrudes to the outside of the back cover 15*b* through an aperture 15*c* formed in the back cover 15*b*, and the other end is pinched between paired rollers 46, rotatably mounted on the back cover 15*b*, in order to regulate the moving direction of the push-in lever 45. However, it is also possible to rotatably mount the shaft 42*a* on the back cover 15*b*, to fix the second rocking lever 42 on the shaft 42*a* and to fix the arm portion 42*c* to the shaft 42*a* as a member separate from the second rocking lever 42.

As explained in the foregoing, there is constituted a rocking slider rotary mechanism by the first rocking lever 41 as a link, the second rocking lever 42 as a crank (except for the arm portion 42*c*) and the slider 43 as a sliding member.

(Returning means for push-in lever)

When the push-in lever 45 is retracted, it cannot be returned to the advanced position by the above-described mechanism. In the following, there will be explained the returning mechanism for the push-in lever.

Figure 17:
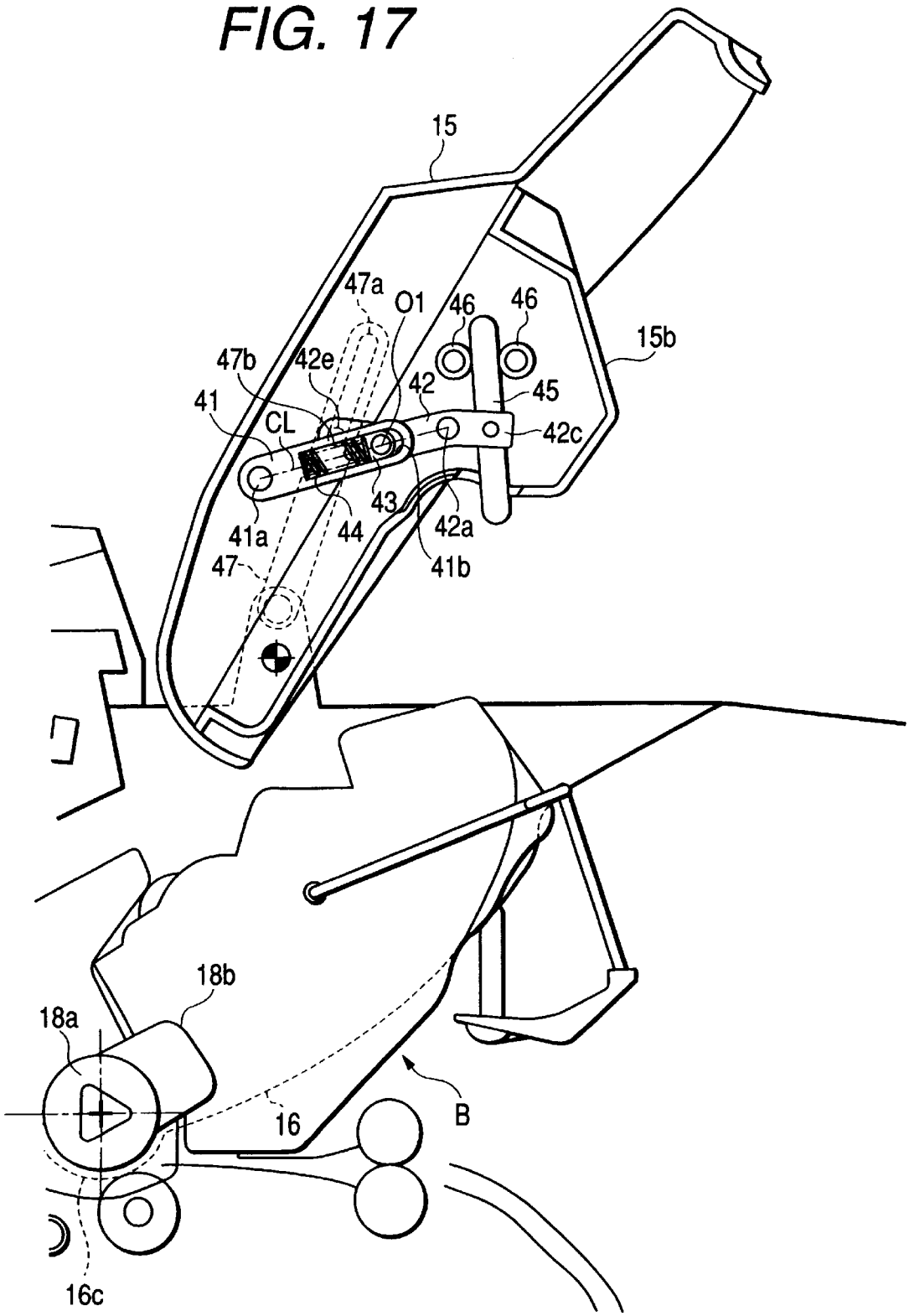

The second rocking lever 42 has an extended portion 42*d* beyond the shaft 42*b* as the end of the crank in the aforementioned rocking slider rotary mechanism, and such extended portion 42*d* is provided with a boss 42*e* that slides along an elongated hole 47*a* of a release lever 47. The release lever 47 is rotatably mounted on a rotary shaft 14*b*, which is provided on a mounting portion 14*a* provided on the main body 14 of the apparatus. The mounting portion 14*a* has the shaft 15*a* for the openable and closable cover 15, but the rotary shaft 14*b* is provided in a position different from that of the shaft 15*a*. Thus, the release lever 47 is mounted on the main body 14 of the apparatus. The elongated hole 47*a* of the release lever 47 is so selected in size that the boss 42*e* does not impinge on the distal end of the elongated hole 47*a* under the rocking motion of the second rocking lever 42. Also, in a situation where the rotary center O1 lies on the rocking lever center line CL as shown in FIG. 17, the boss 42*e* is in contact with the proximal end of the elongated hole 47*a*.

There is also formed another rocking slider rotary mechanism, including the release lever 47 as a link, the second rocking lever 42 (including the extended portion 42*d* but except for the arm portion 42*c*) as a crank and the boss 42 as a slider. This mechanism is provided in addition to the aforementioned rocking slider rotary mechanism but can be linked therewith.

(Function of push-in mechanism for process cartridge)

In the following there will be explained the push-in function for the process cartridge B utilizing the above-described push-in mechanism.

At first, the openable and closable cover 15 is opened and the process cartridge B is inserted. In this state, the rocking levers 41, 42 are in a first state for biasing the push-in lever 45 in such a direction as to protrude from the aperture 15*c* of the back cover 15*b* (cf. FIG. 12).

In the above-mentioned state, the slider 43 is positioned above the rocking lever center line CL and is pressed by the compression coil spring 44 in an expanded state, thus impinging on the terminated end of the slide groove 41*b*. Therefore, the second rocking lever 42 is in a limit position rotated clockwise about the shaft 42*a*, and the arm portion 42*c* is in a clockwise limit position so that the end 45*a* of the push-in lever 45 is in a maximum protruding position from the aperture 15*c* of the back cover 15*b*.

Figure 12:
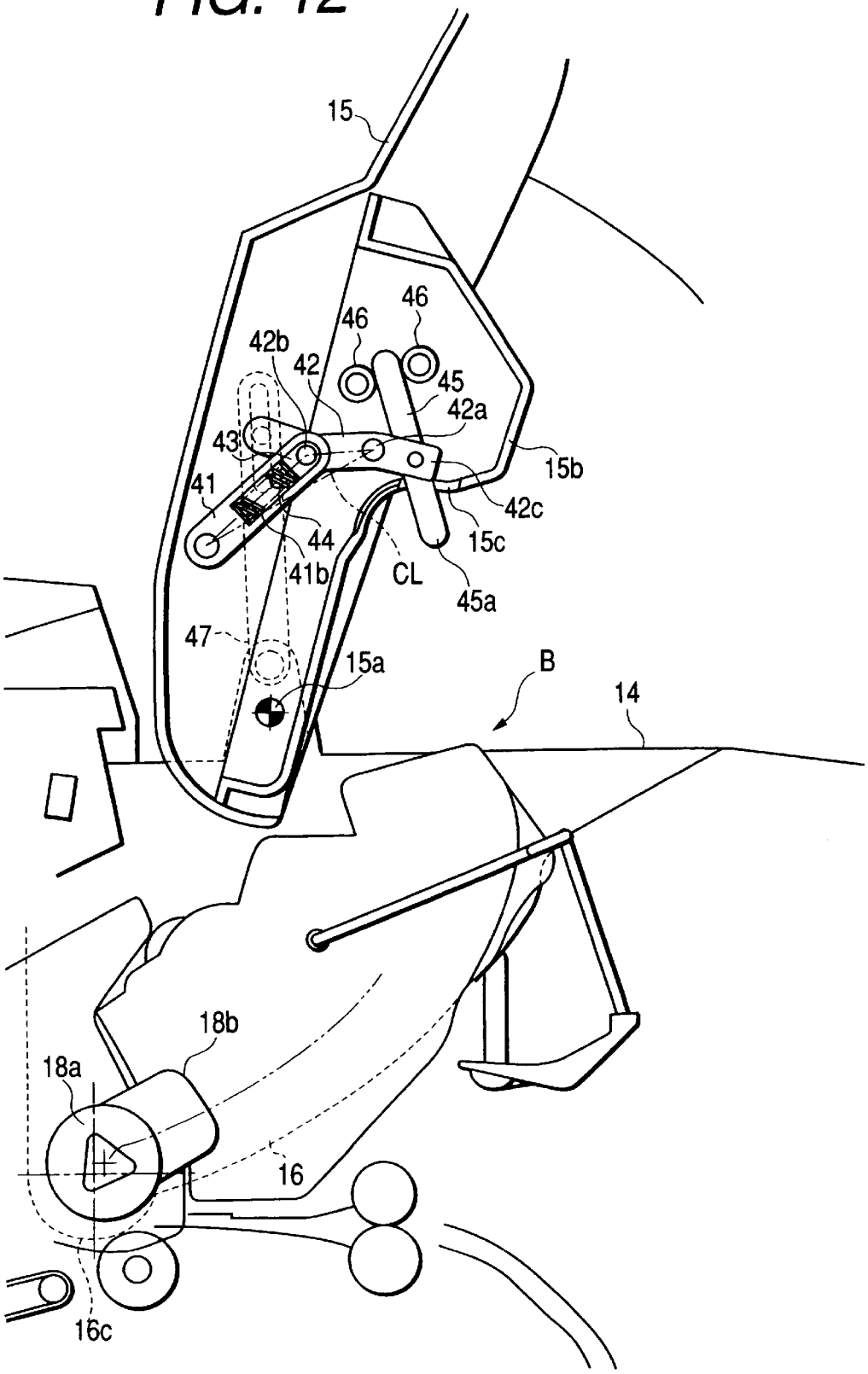
FIGS. 12 and 13 are lateral views showing the mounting action of the process cartridge onto the main body of the apparatus.
Figure 13:
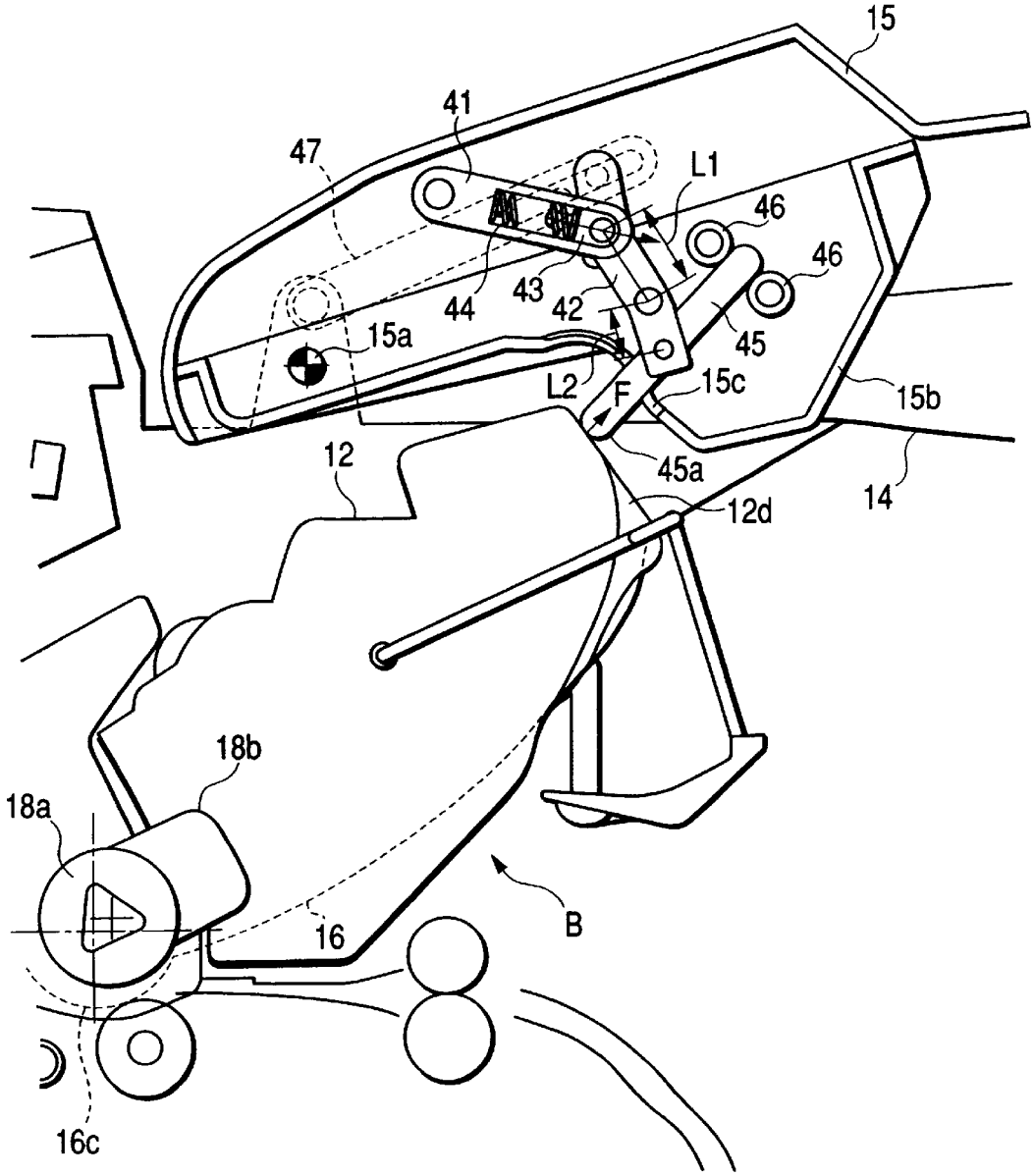
Figure 14:
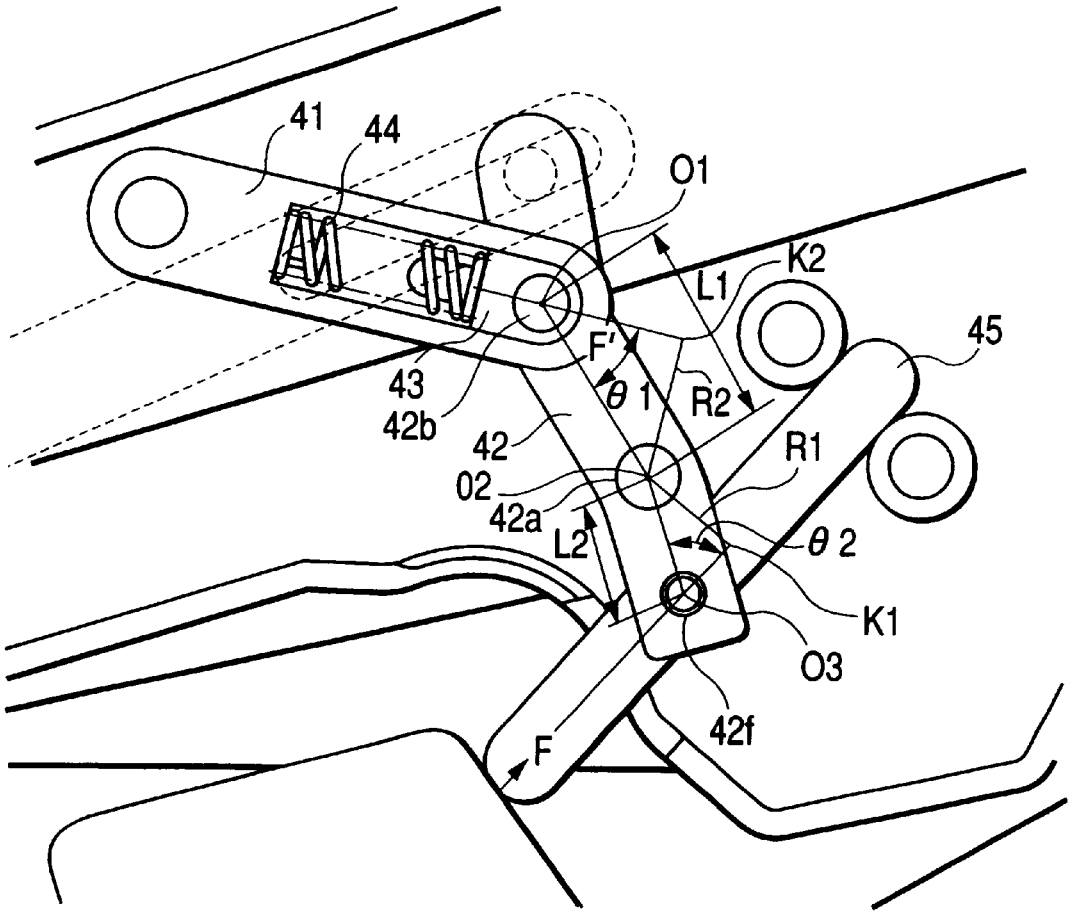
FIG. 14 is a partial magnified view of FIG. 13.

On the insertion of the process cartridge B, if the openable and closable cover 15 is closed in a state in which the boss 18*a* of the guide portion is not properly fitted into the terminated end recess 16*c* of the guide rail 16 in the main body 14 of the apparatus as shown in FIG. 12, the end 45*a* of the push-in lever 45 comes into contact with the trailing end 12*d* of the developing frame member 12 of the process cartridge B before the openable and closable cover 15 can be closed, as shown in FIG. 13. If the openable and closable cover 15 is further pushed in the closing direction, the push-in lever 45 tries to retract but pushes the process cartridge B with a force F as shown in FIG. 14. The force F is represented by:

$$F' \times R2 = F \times R1$$

$$F' \times L1 \times \sin\theta 1 = F \times L2 \times \sin\theta 2$$

$$F = F' \times L1/L2 \times \sin\theta 1/\sin\theta 2$$

wherein F' is a repulsive force of the compression coil spring 44 provided between the first rocking lever 41 and the slider 43; L1 is the distance between the rotary center O2 (center of the shaft 42*a*) of the second rocking lever 42 and the rotary center O1 of the shaft 42*b*; L2 is the distance between the rotary center O2 (center of the shaft 42*a*) and the rotary center O3 (center of the pin 42*f*); R1 is the length of a normal line, with a foot point K1, to the direction of the force F from the rotary center O2; R2 is the length of a normal line, with a foot point K2, to the direction of the force F' from the rotary center O2; θ1 is the angle O2-O1-K2; and θ2 is the angle O2-O3-K1.

Thus, the process cartridge B can be pushed in with the force F in such a manner that the boss 18*a* fits into the terminated end recess 16*c* of the guide rail 16. Stated differently, the force F is selected larger than the mounting resistance of the process cartridge B.

Therefore, as the openable and closable cover 15 is further moved in the closing direction, the process cartridge B is so moved that the boss 18*a* thereof fits into the terminated end recess 16*c* and then the contact surface 20 of the process cartridge B abuts against the impinging member 19 fixed to the main body 14 of the apparatus, whereby the process cartridge B can be mounted in the proper position.

Figure 15:
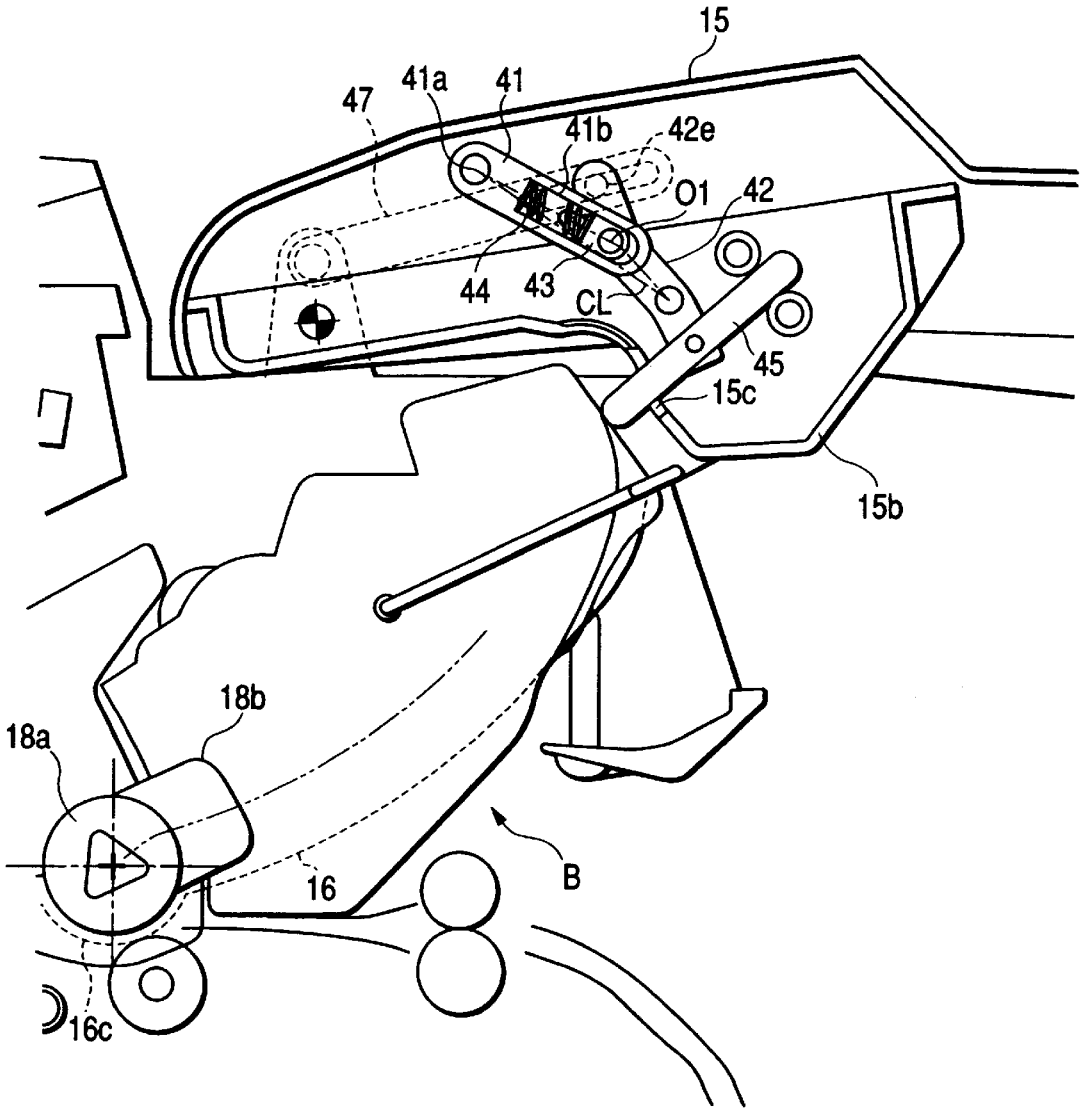
FIG. 15 is a lateral view showing the mounting action of the process cartridge onto the main body of the apparatus.

If the openable and closable cover 15 is not yet completely closed when the push-in lever 45 has pushed the process cartridge B in the proper position, a sensor (not shown) provided on the main body 14 of the apparatus informs the user of the still open state of the openable and closable cover 15. When the openable and closable cover 15 is further moved for complete closing, the reaction force of the trailing end of the process cartridge B on the push-in lever 45 increases, whereby the compressing force on the compression coil spring 44 exceeds the force F'. Thus, the first and second rocking levers 41, 42 start to rotate (cf. FIG. 15), and the slider 43 slides in the slide groove 41b toward the shaft 41*a* while compressing the coil spring 44 and moves toward the rocking lever center line CL along with the rotation of the first and second rocking levers 41, 42. When the rotary center O1 for both the slider 43 and the second rocking lever 42 crosses the rocking lever center line CL, the first and second rocking levers 41, 42 rotate by the repulsive force of the compression coil spring 44 to reach a second state (cf. FIG. 1) in which the push-in lever 45 is retracted, whereupon the openable and closable cover 15 is completely closed and the mounting operation is completed.

In order that the push-in lever 45 can be securely retracted after pushing in the process cartridge B by the closing operation of the openable and closable cover 15, the moving amount X of the leading end of the push-in lever 45 and the penetration amount Y of the end of the push-in lever 45 on the process cartridge B in the proper position have to satisfy a relation:

$$Y>X/2.$$

This relation is required in order that the push-in lever 45 can be retracted after pushing in the process cartridge, because, when the push-in lever 45 moves by a half (X/2) of the moving amount of the end thereof, the rotary center O1 of the fitting hole 43*b* of the slider 43 is positioned on the rocking lever center line CL of the two rocking levers.

In the following there will be explained the opening operation of the openable and closable cover 15.

Figure 16:
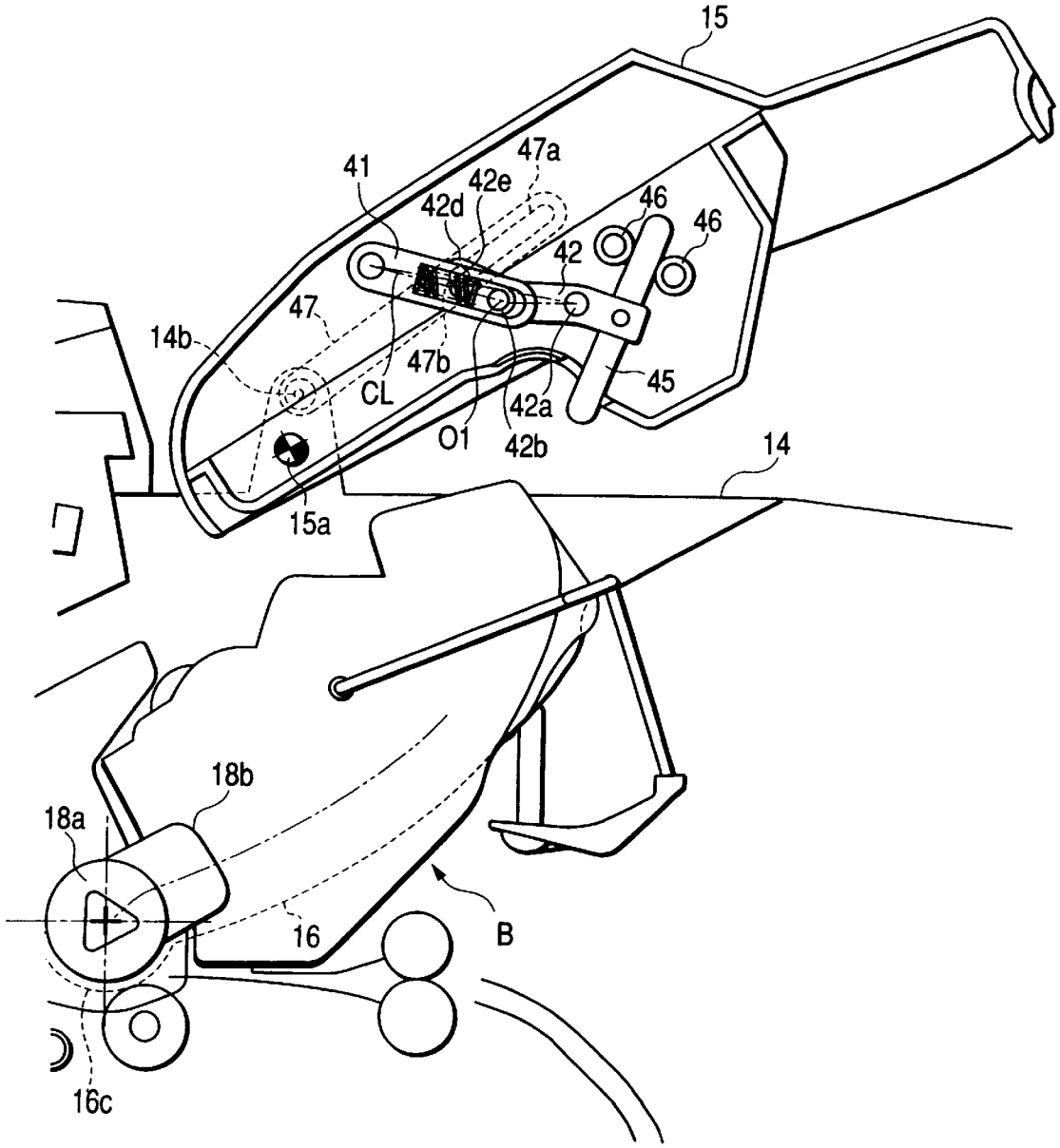
FIGS. 16, 17 and 18 are lateral views showing the actions in opening an openable and closable cover.
Figure 18:
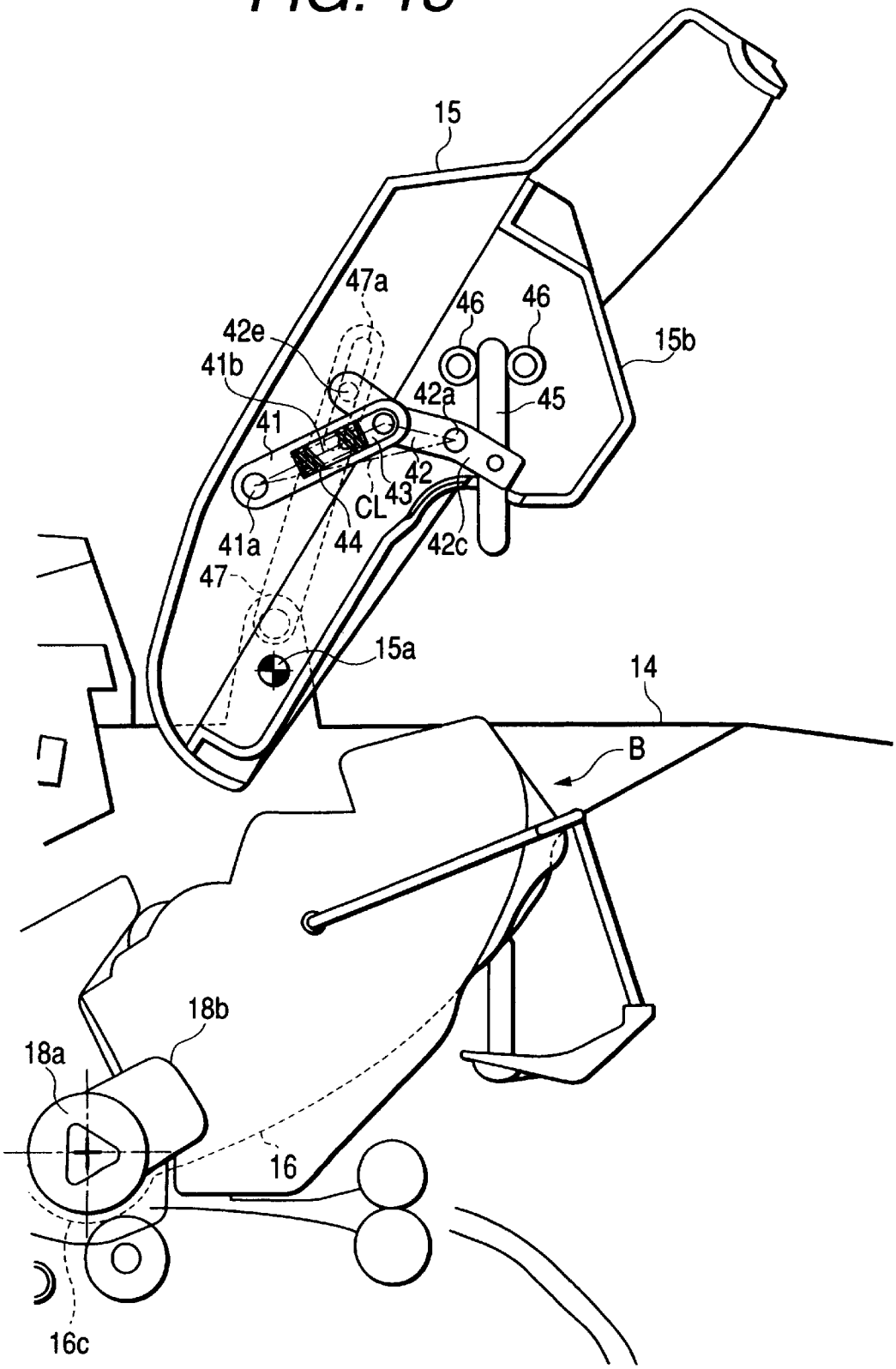

When the openable and closable cover 15 is closed in the mounted state of the process cartridge B, the first and second rocking levers 41, 42 assume the second state with the push-in lever 45 in the retracted position, as explained in the foregoing (cf. FIG. 1). In this state, an end 47*b* of the elongated hole 47*a* of the release lever 47 is in contact with the boss 42*e* of the second rocking lever 42, as shown in FIG. 16. As the openable and closable cover 15 is opened from such state, the end 47*b* of the elongated hole 47*a* of the release lever 47 pushes up the boss 42*e* of the second rocking lever 42, thereby rotating the second rocking lever 42 clockwise in FIG. 16. When the openable and closable cover 15 is opened to a certain position, the fitting hole 43*b* of the slider 43 and the rotary center O1 of the shaft 42*b* of the second rocking lever 42 lie on the rocking lever center line CL of the first and second rocking levers 41, 42 (cf. FIG. 17). When the rocking lever center line CL is exceeded, the spring force of the compression coil spring 44 causes the slider 43 to slide in the slide groove 41*b* toward the distal end of the first rocking lever 41, thereby rotating the first and second rocking levers in such a manner that the distal ends thereof move upwards away from the rocking lever center line CL in FIG. 17. Thus, the arm portion 42*c* advances and allows the push-in lever 45 to move to the first state where the push-in lever 45 protrudes (cf. FIG. 18).

Figure 19:
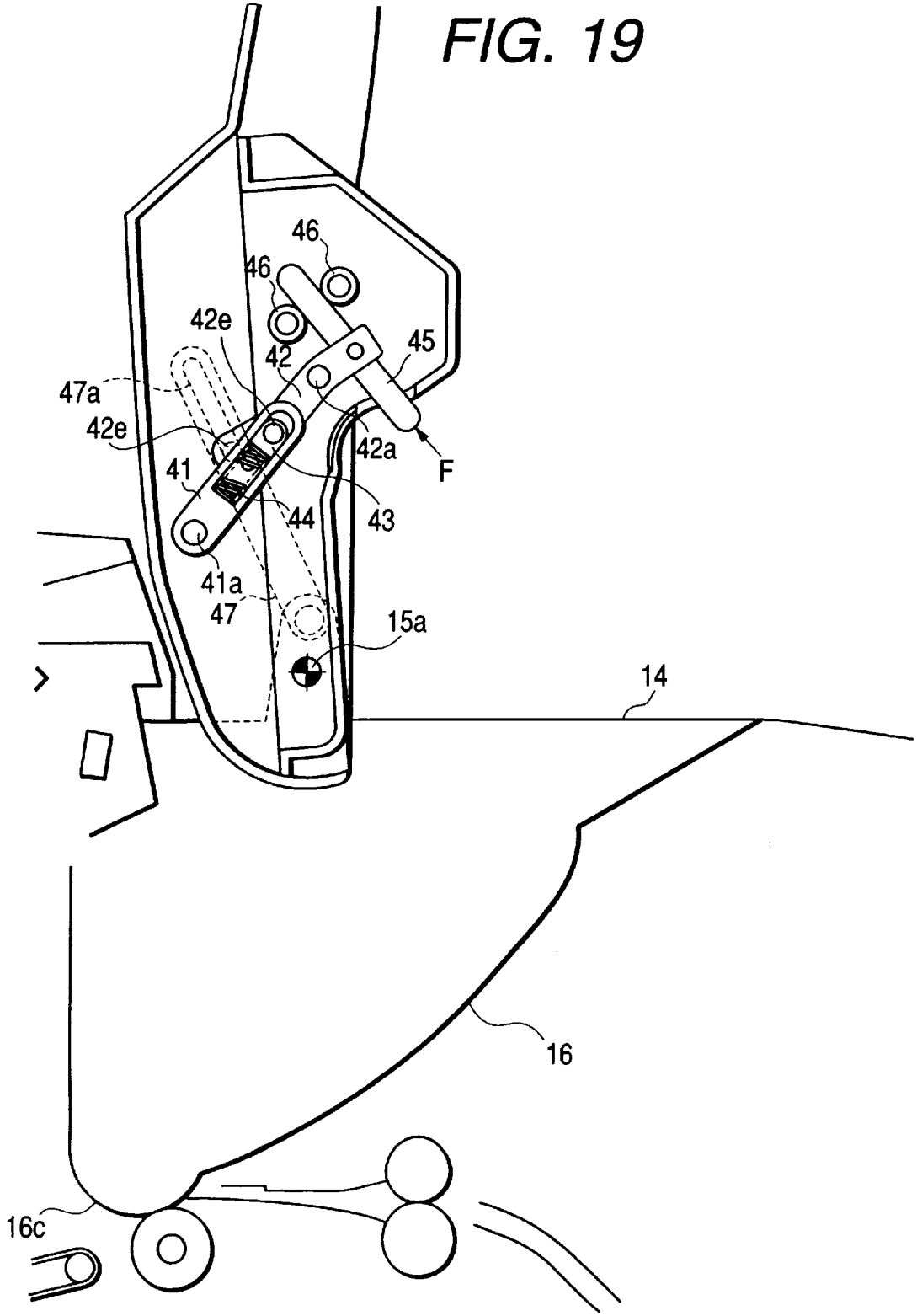

As explained in the foregoing, the push-in mechanism 40, in the second state in which the push-in lever 45 is retracted, can be moved, by the opening operation of the openable and closable cover 15, to the first state in which the push-in lever 45 is protruded. Therefore, even if the push-in lever is intentionally pushed in while the openable and closable cover 15 is in the open state (cf. FIG. 19), when the state shown in FIG. 17 is reached in the course of closing operation of the openable and closable cover 15, the end 47*b* of the elongated hole 47*a* of the release lever 47 displaces the boss 42*e* of the second rocking lever 42 thereby attaining the first state in which the push-in lever 45 is protruded.

The above-described push-in mechanism 40 allows the device to prevent incomplete mounting of the process cartridge B since, even if the process cartridge B remains in a half inserted state, the push-in lever 45 of the push-in mechanism 40 in the course of closing operation of the openable and closable cover 15 pushes the trailing end of the process cartridge B by the spring force of the compression coil spring provided in the first rocking lever 41 until the boss 18*a* of the process cartridge B fits into the recess 16*c* at the terminated end of the guide rail 16 in the main body 14 of the apparatus. Also, after the process cartridge B is pushed in and after the openable and closable cover 15 is completely closed, the push-in lever 45 is retracted to a position securely separated from the process cartridge B, so that the image forming operation is not affected.

As explained above, the foregoing embodiment provides a push-in mechanism including a push-in lever that can move between a first state in which the push-in lever is biased in the inserting direction of the process cartridge and a second state in which the push-in lever is biased in the extracting direction of the process cartridge in association with the closing operation of the openable and closable cover, and biasing means for biasing the push-in lever so as to move into the first or second states, wherein, when the process cartridge is inserted into the main body of the electrophotographic image forming apparatus and the openable and closable cover is moved in the closing direction, the push-in lever biased in the first state in the process cartridge push-in mechanism comes into contact with the process cartridge with a biasing force toward the inserting direction. When the openable and closable cover is closed, the push-in lever moves into the second state and the end of the push-in lever is separated from the process cartridge, whereby the push-in lever is retracted therefrom after the process cartridge is securely pushed into the proper position. Consequently in the push-in operation of the process cartridge, the pushing position thereon is not limited, and the process cartridge in the mounted state is not pressurized.

Also, in the process cartridge push-in mechanism, there is provided returning means for moving the push-in lever, which is in the retracted second state, to the advanced first state in association with the opening operation of the openable and closable cover, whereby, in case of opening the openable and closable cover to clear a jammed sheet or to replace the process cartridge with a new one, it is possible to prevent the push-in lever from being automatically moved into the state of pushing in the process cartridge.

Also, in the process cartridge push-in mechanism, there are provided a rocking slider rotary mechanism, an elastic member for biasing the slider, an arm integrally rotating with the second rocking lever as a crank of the rocking slider rotary mechanism, and a push-in lever linked with the arm, whereby the push-in lever can be biased into the first and second states by a single biasing means.

Also, in the push-in lever of the process cartridge push-in mechanism, the moving amount X of the end of the push-in lever 45, when the push-in lever 45 is moved from the first state into the second state and the penetration amount Y of the end of the push-in lever 45 penetrating an outline of the process cartridge B when the push-in lever 45 is in the first state and when the openable and closable cover is completely closed satisfy a relation:

$$Y>X/2$$

whereby the push-in lever can be moved into the second state in which the push-in lever is retracted from the process cartridge, by the closing operation of the openable and closable cover.

The returning means of the process cartridge push-in mechanism comprises a release lever provided at an end with a rotary center different from a rotary center of the openable and closable cover and provided with a slide of a limited length along the release lever, wherein the slide of the release lever slidably and rotatably engages with the second rocking lever. When the openable and closable cover is moved for opening while the push-in lever linked with the second rocking lever is in the second state, the connecting portion between the second rocking lever and the release lever at a terminated end of the slide of the release lever is prevented from movement, whereby the release lever rotates the second rocking lever by the opening operation of the openable and closable cover. When the connecting portion of the first and second rocking levers crosses the line connecting the rotary centers of the first and second rocking levers, the push-in lever is moved into the first state. Therefore, the push-in lever in the retracted second state can be moved into the aforementioned first state by the opening operation of the openable and closable cover, and, even if the push-in lever is intentionally moved into the second state while the openable and closable cover is opened, it can be moved into the first state in the course of the closing operation of the openable and closable cover.

Also, the aforementioned push-in lever is regulated in motion between the paired rollers mounted on the openable and closable cover and is capable of advancing with rocking motion substantially in the mounting direction of the process cartridge, so that the push-in lever executes rocking motion while advancing between the paired rollers, thereby pushing and rocking the process cartridge, which is inserted but not mounted in the proper position, whereby the process cartridge can be securely set in the proper position.

Also, the process cartridge push-in mechanism is provided with a push-in lever, provided movably on the openable and closable cover, for pushing the process cartridge to the mounting position in contact therewith, and a reversing device for reversing and retracting the push-in lever from the process cartridge after it is pushed by the push-in lever into the mounting position, so that such push-in mechanism can be adopted in the process cartridge mounting means and can avoid pressurizing on the process cartridge after mounting thereof.

Also, the aforementioned reversing device comprises a rocking slider rotary mechanism with a limited rotary angle of the crank, wherein the push-in lever is pivotably connected to the distal end of an arm portion integrally rocking with the crank pivotably connected to the openable and closable cover about the crank rotary center, so that the force applied to the process cartridge by the push-in lever decreases before reaching the reversing state, whereby the process cartridge can be protected from the unnecessary force.

Also, the aforementioned reversing device is provided with a link device having a crank and a link with respectively different rotary centers fixed to the openable and closable cover, wherein the rocking distal end of the crank is connected to the link rotatably and slidably in a limited length with respect to the link and the distal end of an arm integrally rotating with the crank about a rotary center of the crank pivotably connected to the openable and closable cover is pivotably connected to the aforementioned push-in lever, and also with an elastic member for biasing the connecting portion of the distal end of the crank and the link in such a manner as to move away from the rotary center, whereby the rocking distal end of the crank is slidable with respect to the link and is braked by the sliding resistance in the reversing operation even after moving beyond the dead center position, so that the reversing device can achieve a quiet operation.

Also the link and the arm portion mentioned above are integral, so that the process cartridge push-in mechanism can be constructed in a planar manner.

Also, on the aforementioned reversing device, there is provided returning means for returning the push-in lever into a state in which the push-in lever can push the process cartridge in association with the opening operation of the openable and closable cover, whereby the state of the push-in lever can be restored by merely opening and closing the openable and closable cover.

Also, there is provided a rocking slider rotary mechanism comprising a link pivotably connected to the openable and closable cover at a rotary center movable with respect to the main body of the image forming apparatus by an opening operation, and the crank of the aforementioned reversing device, whereby the restoration of the reversing device is facilitated and the space required for the openable and closable cover can be made smaller even when the returning device is provided in superposition with the reversing device.

As explained in the foregoing, the present invention allows the device to securely mount the process cartridge on the main body of the image forming apparatus.

While the invention has been described with reference to the structures disclosed herein, it is not confined to the details set forth and this application is intended to cover such modifications or changes as may come within the purposes of the improvements or the scope of the following claims.

What is claimed is:

1. A process cartridge push-in mechanism for mounting a process cartridge in a mounting position provided in a main body of an electrophotographic image forming apparatus, wherein said process cartridge integrally includes an electrophotographic photosensitive member and process means acting on the electrophotographic photosensitive member, said push-in mechanism comprising:

a) moving means for contacting the process cartridge and moving the process cartridge to the mounting position in response to a closing operation of an openable and closable cover provided in the main body of said electrophotographic image forming apparatus, wherein the openable and closable cover can be opened and closed with respect to the main body of the electrophotographic image forming apparatus and is to be opened for mounting and dismounting the process cartridge to and from the main body of the electrophotographic image forming apparatus; and b) separation means for separating said moving means from the process cartridge after the process cartridge is moved to the mounting position.

2. A process cartridge push-in mechanism according to claim 1, wherein said moving means comprises a push-in lever which is contactable with a trailing end of a toner development frame of the process cartridge to move the process cartridge toward the mounting position.

3. A process cartridge push-in mechanism according to claim 1, wherein said separation means includes a first rocking lever, a second rocking lever, a slider, and a compression coil spring, wherein said first and second rocking levers are rotated by a repulsive force received by a push-in lever from the process cartridge mounted in the mounting position, and, when a rotary center of said slider and said second rocking lever moves beyond a center line of said first and second rocking levers, said first and second rocking levers are rotated by a repulsive force of said compression coil spring, whereby said push-in lever is separated from said process cartridge.

4. A process cartridge push-in mechanism according to claim 3, wherein said first and second rocking levers, said slider and said compression coil spring of said separation means serve to elastically bias said push-in lever as said moving means, whereby said first and second rocking levers, said slider and said compression coil spring serve also as said moving means.

5. A process cartridge push-in mechanism according to claim 1, 2, 3 or 4, wherein the moving means separated from the process cartridge by said separation means returns to a position in which said moving means is contactable with the process cartridge, in association with an opening operation of the openable and closable cover.

6. An electrophotographic image forming apparatus to which a process cartridge is detachably mountable for forming an image on a recording medium, said electrophotographic image forming apparatus comprising:

a) an openable and closable cover that can be opened or closed with respect to a main body of said electrophotographic image forming apparatus and is to be opened for mounting and detaching the process cartridge to and from the main body of said electrophotographic image forming apparatus;

b) moving means for contacting the process cartridge and moving the process cartridge to a mounting position in response to a closing operation of said openable and closable cover, wherein said openable and closable cover can be opened and closed with respect to the main body of said electrophotographic image forming apparatus and is to be opened for mounting and detaching the process cartridge to and from the main body of said electrophotographic image forming apparatus;

c) separation means for separating said moving means from the process cartridge after the process cartridge is moved to the mounting position; and d) conveying means for conveying the recording medium.

7. An electrophotographic image forming apparatus according to claim 6, wherein said moving means comprises a push-in lever that is contactable with a trailing end of a toner development frame of the process cartridge to move the process cartridge toward the mounting position.

8. An electrophotographic image forming apparatus according to claim 6, wherein said separation means includes a first rocking lever, a second rocking lever, a slider and a compression coil spring, wherein said first and second rocking levers are rotated by a repulsive force received by a push-in lever from the process cartridge mounted in the mounting position, and, when a rotary center of said slider and said second rocking lever moves beyond a center line of said first and second rocking levers, said first and second rocking levers are rotated by the repulsive force of said compression coil spring, whereby said push-in lever is separated from the process cartridge.

9. An electrophotographic image forming apparatus according to claim 8, wherein said first and second rocking levers, said slider and said compression coil spring of said separation means serve to elastically bias said push-in lever as said moving means, whereby said first and second rocking levers, said slider and said compression coil spring serve also as said moving means.

10. An electrophotographic image forming apparatus according to claim 6, 7, 8 or 9, wherein said moving means separated from the process cartridge by said separation means returns to a position in which said moving means is contactable with the process cartridge, in association with an opening operation of said openable and closable cover.

11. An electrophotographic image forming apparatus to which a process cartridge is detachably mountable for forming an image on a recording medium, said electrophotographic image forming apparatus comprising:

a) mounting means for detachably mounting a process cartridge, the process cartridge including:
an electrophotographic photosensitive drum; and
process means acting on the electrophotographic photosensitive drum; and b) conveying means for conveying the recording medium, wherein said mounting means includes:
an openable and closable cover for opening and closing a mounting portion for the process cartridge;
guide means for guiding the process cartridge to a mounting position; and
a positioning portion provided in said guide means for positioning the process cartridge in the mounting position of a main body of said electrophotographic image forming apparatus,
wherein said openable and closable cover is provided with a process cartridge push-in mechanism having a push-in lever movable between a first state in which said push-in lever is biased in an inserting direction of the process cartridge and a second state in which said push-in lever is biased in a direction opposite to the inserting direction in association with a closing operation of the openable and closable cover, and biasing means for biasing said push-in lever to the first and second state, wherein, in said process cartridge push-in mechanism, said push-in lever biased to the first state is brought into contact with the process cartridge with a biasing force for biasing the process cartridge in the inserting direction when the process cartridge is inserted in said main body of said electrophotographic image forming apparatus and when the openable and closable cover is moved in a closing direction, and, when the openable and closable cover is closed, said push-in lever is moved into the second state, whereby an end of said push-in lever is separated from the process cartridge.

12. An electrophotographic image forming apparatus according to claim 11, wherein said process cartridge push-in mechanism further includes returning means for moving the push-in lever, that has been moved into said second state, into said first state in association with an opening operation of said openable and closable cover.

13. An electrophotographic image forming apparatus according to claim 11, wherein said biasing means of said process cartridge push-in mechanism includes:

a rocking slider rotary mechanism provided with a first rocking lever, a second rocking lever linked to said first rocking lever so as to be rotatable and movable along said first rocking lever, said first and said second rocking levers being pivotably provided in a mutually separate manner on said openable and closable cover, and an arm portion integrally rotatable with said second rocking lever about a rotary center of said second rocking lever and pivotably provided on said push-in lever; and an elastic member for biasing a connecting portion of said first and said second rocking levers so as to move away from a rotary center of said first rocking lever.

14. An electrophotographic image forming apparatus according to any one of claims 11 to 13, wherein, in said process cartridge push-in mechanism, a moving amount X of the end of said push-in lever when said push-in lever moves from the first state to the second state and a penetration amount Y of the end of said push-in lever into an external shape of the process cartridge when said push-in lever is in the first state and when said openable and closable cover is completely closed satisfy a relation:

$$Y>X/2.$$

15. An electrophotographic image forming apparatus according to any one of claims 11 to 13, wherein, in said process cartridge push-in mechanism, returning means comprises a release lever provided at an end with a rotary center on the main body of said image forming apparatus different from a rotary center of said openable and closable cover rotatably mounted on said main body and provided with a slide of a limited length along said release lever, wherein a second rocking lever is connected rotatably and slidably with the slide of said release lever, and, when the openable and closable cover is moved in an opening direction while said push-in lever connected to said second rocking lever is in said second state, a connecting portion of said second rocking lever is blocked from motion by a terminated end of the slide of said release lever, whereby the release lever rotates the second rocking lever in association with the opening operation of the openable and closable cover, and, when the connection portion of said first and said second rocking levers moves over a line connecting rotary centers of said first and said second rocking levers, the push-in lever is moved into the first state.

16. An electrophotographic image forming apparatus according to any one of claims 11 to 13, wherein said push-in lever is limited in motion by paired rollers mounted on said openable and closable cover so that said push-in lever is forwardly movable while executing a rocking motion.

17. A process cartridge push-in mechanism provided on an openable and closable cover of a cartridge mounting portion in a main body of an image forming apparatus, for pushing a process cartridge to be mounted in the cartridge mounting portion to a mounting position, said process cartridge push-in mechanism comprising:

a push-in member having a push-in lever movably provided on said openable and closable cover for being brought in contact with the process cartridge and to push the process cartridge into the mounting position; and reversing means for reversing and retracting said push-in lever when said push-in lever has pushed the process cartridge into the mounting position, thereby separating said push-in lever from the process cartridge.

18. A process cartridge push-in mechanism according to claim 17, wherein said reversing means comprises a rocking slider rotary mechanism with a limited rotation angle of a crank, wherein said push-in lever is pivotably provided on a distal end of an arm portion integrally rocking with said crank about a rotary center provided on said openable and closable cover.

19. A process cartridge push-in mechanism according to claim 17, wherein said reversing means includes:

a link device having a crank and a link pivotably provided on said openable and closable cover at respectively different rotary centers, wherein a rocking distal end of said crank is connected to said link rotatably and slidably in a limited length with respect to said link and a distal end of an arm portion integrally rotating with said crank about the rotary center, provided on said openable and closable cover, of said crank is pivotably provided on said push-in member; and an elastic member for biasing a connecting portion of the distal end of said crank and said link in such a manner as to move away from the rotary center of said link.

20. A process cartridge push-in mechanism according to claim 19, wherein said link and said arm portion are integral.

21. A process cartridge push-in mechanism according to any one of claims 17 to 20, wherein said reversing means includes returning means for returning said push-in member to a state in which said push-in lever can push in the process cartridge in association with an opening operation of said openable and closable cover.

22. A process cartridge push-in mechanism according to claim 21, wherein said returning means constitutes a rocking slider rotary mechanism by a link pivotably provided on said openable and closable cover at a rotary center immovable with respect to the main body of the image forming apparatus by the opening operation of said openable and closable cover, and a crank formed by extending the distal end of said crank of said reversing means.

* * * * *

UNITED STATES PATENT AND TRADEMARK OFFICE

CERTIFICATE OF CORRECTION

PATENT NO. : 6,229,974 B1
DATED : May 8, 2001
INVENTOR(S) : Shinya Noda

It is certified that error appears in the above-identified patent and that said Letters Patent is hereby corrected as shown below:

Title page,
Item [57], ABSTRACT
Line 5, "process" should read -- a process--.

Column 5,
Line 48, "the" (first occurrence) should read -- a --.
Line 49, "a" should read -- the --.

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*